US009321615B2

(12) United States Patent
Shaw et al.

(10) Patent No.: US 9,321,615 B2
(45) Date of Patent: Apr. 26, 2016

(54) PANEL HOIST

(71) Applicant: Snap-on Incorporated, Kenosha, WI (US)

(72) Inventors: Greg W. Shaw, Lapeer, MI (US); William Kreiner, Brown City, MI (US)

(73) Assignee: Snap-on Incorporated, Kenosha, WI (US)

( * ) Notice: Subject to any disclaimer, the term of this patent is extended or adjusted under 35 U.S.C. 154(b) by 0 days.

(21) Appl. No.: 14/022,942

(22) Filed: Sep. 10, 2013

(65) Prior Publication Data

US 2014/0294540 A1 Oct. 2, 2014

Related U.S. Application Data

(60) Provisional application No. 61/807,746, filed on Apr. 2, 2013.

(51) Int. Cl.

| | |
|---|---|
| ***E04F 21/18*** | (2006.01) |
| ***B66C 23/48*** | (2006.01) |
| ***B66C 1/02*** | (2006.01) |

(52) U.S. Cl.

CPC ..... *B66C 23/48* (2013.01); *B66C 1/0243* (2013.01); *B66C 1/0287* (2013.01); *E04F 21/1811* (2013.01); *E04F 21/1816* (2013.01); *E04F 21/1822* (2013.01); *E04F 21/1872* (2013.01)

(58) Field of Classification Search

CPC .... B66C 23/48; B66C 1/0262; B66C 1/0293; B66C 1/0243; E04F 21/1822; E04F 21/1888; B65G 2249/04; B65G 49/067; B65G 49/061; B65G 49/068; B66F 5/00; B66F 5/04; B66F 9/181; Y10S 212/901

USPC ..... 248/172, 276.1, 278.1, 283.1, 284.1, 248/299.1; 254/3 C, 8 B; 269/104, 140, 21, 269/905; 294/187, 65; 414/10–12, 627, 414/684.3, 694, 737; 74/105; 901/40

See application file for complete search history.

(56) References Cited

U.S. PATENT DOCUMENTS 2,312,914 A * 3/1943 Koszeghy ..... 269/104
2,772,797 A * 12/1956 Schreck ..... 414/687

(Continued)

FOREIGN PATENT DOCUMENTS

FR 2756549 A1 2/1996
FR 2828875 A1 * 2/2003 ..... B65G 7/00

OTHER PUBLICATIONS

International Searching Authority, Form PCT/ISA/210, Patent Cooperation Treaty, PCT, International Search Report regarding international application No. PCT/US2014031956, 4 pages, Jul. 30, 2014.

(Continued)

*Primary Examiner* — Gregory Adams
(74) *Attorney, Agent, or Firm* — McDonnell Boehnen Hulbert & Berghoff LLP

(57) ABSTRACT

A panel hoist and components of various kits including components of a panel hoist are described herein. A panel hoist can be used to hold any of a variety of panels, such as a door attachable to a semi-tractor trailer, and to maneuver the panel for putting into a position for mounting the panel to a panel mounting point or for removing a panel disconnected from a panel mounting point. Various types of suction cups and supplemental panel holders can be used to hold the panel while the panel is moved or prepared for movement. A panel hoist can allow a single person to maneuver panels in various ways instead of having to rely on multiple people to maneuver the panel. Maneuvering the panel can include raising, lowering, or rotating the panel. Various panel hoist components can be configured as a kit.

22 Claims, 14 Drawing Sheets

(56) References Cited

U.S. PATENT DOCUMENTS

| | | | | | |
|---|---|---|---|---|---|
| 3,058,602 | A | | 10/1962 | Kilman | |
| 3,349,977 | A | * | 10/1967 | Caminiti | 224/314 |
| 3,734,304 | A | * | 5/1973 | Cabaniss | 414/732 |
| 4,228,993 | A | * | 10/1980 | Cathers | 271/236 |
| 4,600,348 | A | * | 7/1986 | Pettit | 414/11 |
| 4,955,592 | A | | 9/1990 | Brennan, Sr. | |
| 5,011,364 | A | * | 4/1991 | Anderson | 414/694 |
| 5,173,002 | A | | 12/1992 | Brennan, Sr. | |
| 5,202,132 | A | | 4/1993 | Myers et al. | |
| 5,224,808 | A | * | 7/1993 | Macris | 414/11 |
| 5,259,721 | A | * | 11/1993 | Sato et al. | 414/620 |
| 5,275,390 | A | | 1/1994 | Brennan | |
| 5,299,787 | A | | 4/1994 | Svensson | |
| 5,516,254 | A | * | 5/1996 | Gessler | 414/607 |
| 5,645,272 | A | | 7/1997 | Brennan, Sr. | |
| 5,658,113 | A | | 8/1997 | Lazo | |
| 5,704,755 | A | | 1/1998 | Jesperson | |
| 5,913,561 | A | | 6/1999 | Alcorn | |
| 6,056,499 | A | * | 5/2000 | Bressner | 414/621 |
| 6,120,236 | A | | 9/2000 | Smith | |
| 6,579,051 | B2 | * | 6/2003 | Echternacht | 414/11 |
| 6,722,842 | B1 | * | 4/2004 | Sawdon et al. | 414/729 |
| 7,164,391 | B2 | * | 1/2007 | Lin et al. | 343/882 |
| 7,448,598 | B1 | | 11/2008 | Elmlinger et al. | |
| 7,581,915 | B1 | | 9/2009 | Bristol | |
| 7,686,310 | B2 | | 3/2010 | Perkins | |
| 7,887,109 | B2 | * | 2/2011 | Liao | 294/187 |
| 7,988,161 | B2 | * | 8/2011 | Kilday | 280/79.11 |
| 8,403,112 | B2 | | 3/2013 | Bonanno et al. | |
| 2002/0100851 | A1 | * | 8/2002 | Abramowsky et al. | 248/284.1 |
| 2003/0190219 | A1 | * | 10/2003 | Young | 414/11 |
| 2006/0208240 | A1 | * | 9/2006 | Spittle et al. | 254/8 B |
| 2007/0104558 | A1 | | 5/2007 | Narelli | |
| 2010/0207085 | A1 | * | 8/2010 | Thurm | 254/2 C |

OTHER PUBLICATIONS

International Searching Authority, Form PCT/ISA/237, Written Opinion of the International Searching Authority regarding International Application No. PCT/US2014/031956, 6 pages, Jul. 30, 2014.

Vacuplifter, Drywall Lifter, screen shots of video uploaded on Jun. 10, 2011 and viewable from the World Wide Web address https://www.youtube.com/watch?v=CCiKJUprmk8 on Aug. 14, 2014.

All-Vac-Lift, All-Vac-Lift for wood, downloaded from the World Wide Web at http://web.archive.org/web/20090107052734/http://www.vac-lift.com/wood.html, dated Jan. 7, 2009, 5 pages.

All-Vac-Lift, VacLift PL180, downloaded from the World Wide Web at http://web.archive.org/web/20110503073434/http://www.vac-lift.com/180.html, dated May 3, 2011, 7 pages.

All-Vac-Lift, All-Vac-Lift for plates, downloaded from the World Wide Web at http://web.archive.org/web/20110503073608/http://www.vac-lift.com/plates.html, dated May 3, 2011, 5 pages.

Grainger Inc., Scissor Lift Cart, 400 lb., Steel, Tilt, 3 pages, downloaded from the World Wide Web at http://www.grainger/com/Grainger/Scissor-Lift-Cart-2TKY6, Apr. 3, 2013.

Harbor Freight Tools, Pittsburgh Automotive Air/Hydraulic Bottle Jack—Owner's Manual & Safety Instructions, 16 pages, Jul. 21, 2011.

Venturi Jet Pumps Ltd, Air Ejectors, 1 page, downloaded from the World Wide Web at http://www.venturipumps.com/airejector.htm, Apr. 12, 2013.

Wikipedia, Mechanical Joint, 8 pages, downloaded from the World Wide Web at http://en.wikipedia.org/wiki/Mechanical_joint, Jun. 21, 2013.

Coval Inc., Heavy duty in-line ejectors, VR 05, 07, 09 series, and Ejector Fittings, VR 10, 12, 14, series, 4 pages, Mar. 19, 2012.

Coval Inc., High-performance suction pads, C series, 3 pages, Mar. 19, 2012.

The Incredible Hoist, Photo Gallery, 2 pages, downloaded from the World Wide Web at http://www.incrediblehoist.com/, Apr. 12, 2013.

Numatics, Inc., Numatics Vacuum Products, Emerson Industrial Automation, 85 pages, Mar. 2012.

Blickle Rader+Rollen GMBH U. Co. KG., Wheels and Castors Guide, Basics / Terminology, 1 page, Jan. 27, 2012.

Manufacturer Express, Inc., Ratchet Strap, 2 pages, downloaded from the World Wide Web at http://www.mfrexpress.com, Jun. 20, 2013.

* cited by examiner

PANEL HOIST

This application claims the benefit of U.S. Provisional Patent Application No. 61/807,746, filed Apr. 2, 2013. U.S. Provisional Patent Application No. 61/807,746 is incorporated herein by reference.

BACKGROUND

Panels, such as door panels and side panels of a semi-tractor trailer, are produced in a variety of configurations. The various configurations can differ, in part, based on the size and weight of the panels. Lifting and holding panels while attaching the panels to a panel attachment item such as a wall or a semi-tractor trailer can be a job that requires multiple people to lift and hold the panel while one or more other people attach the panel to the panel attachment item. It would be beneficial to reduce the number of people required to maneuver, attach, and remove panels.

OVERVIEW

Example embodiments are described herein. In one respect, an example embodiment can take the form of a panel hoist comprising: (i) a base, (ii) a hoist arm connected to the base, (iii) a jack configured to raise and lower the hoist arm, (iii) a panel holder, (iv) a rotator configured to rotate the panel holder, (v) a first rotatable joint that connects the hoist arm to the panel holder, and (vi) a second rotatable joint that connects the rotator to the panel holder.

In another respect, an example embodiment can take the form of a kit comprising: (i) a panel holder, (ii) a rotator configured to rotate the panel holder, (iii) a first rotatable joint adapted to be connected to the panel holder and to a hoist arm of a hydraulic engine lift, (iv) a second rotatable joint adapted to connect the rotator to the panel holder, and (v) a plurality of suction cups adapted for connection to the panel holder.

These as well as other aspects and advantages will become apparent to those of ordinary skill in the art by reading the following detailed description, with reference where appropriate to the accompanying drawings. Further, it should be understood that the embodiments described in this overview and elsewhere are intended to be examples only and do not necessarily limit the scope of the invention.

BRIEF DESCRIPTION OF THE DRAWINGS

Example embodiments are described herein with reference to the drawings, in which.

DETAILED DESCRIPTION

I. Introduction

This description describes a panel hoist (or more simply, a "hoist") in accordance with one or more example embodiments. This description also describes various alternative arrangements of the panel hoist example embodiments.

The panel hoists described herein can be used to perform any of a variety of operations including, but not limited to, handling, repositioning, lifting, raising, carrying, transporting, or lowering a panel or panel-like item. The panel or panel-like item can comprise any of a variety of items including, but not limited to, a door, a side panel, floor panel, or ceiling panel of a semi-tractor trailer, a board (for example, a long, thin, piece of word or other hard material), a glass panel, a fiberglass panel, or a sheet of metal. By way of example, the board can comprise a cement board, a drywall board, or a sheet of plywood. A door can comprise, but is not limited to, a door configured for attachment to or removal from a van or tractor trailer. A panel hoist useable or used with respect to doors can be referred to as a door handling tool.

In this description, the articles "a" or "an" are used to introduce elements of the example embodiments. The intent of using those articles is that there is one or more of the elements. The intent of using the conjunction "or" within a described list of at least two terms is to indicate any of the listed terms or any combination of the listed terms. The use of ordinal numbers such as "first," "second," "third" and so on is to distinguish respective elements rather than to denote a particular order of those elements.

This description describes one or more components as being "removably attached" or "removably attachable." The terms "removably attached" and "removably attachable" and other forms thereof indicate that the component can be attached to one or more other components and subsequently removed from any or all of the one or more other components. Removably attachable components can be attached and removed multiple times. Any two or more components described in this description or shown in any figure as being connected or attached can be removably attached.

The images shown in the figures are provided merely as examples and are not intended to be limiting. Many of the elements illustrated in the figures or described herein are functional elements that can be implemented as discrete or distributed components or in conjunction with other components, and in any suitable combination and location. Those skilled in the art will appreciate that other arrangements and elements (e.g., machines, interfaces, functions, orders, or groupings of functions) can be used instead.

II. Example Architecture

Figure 1:
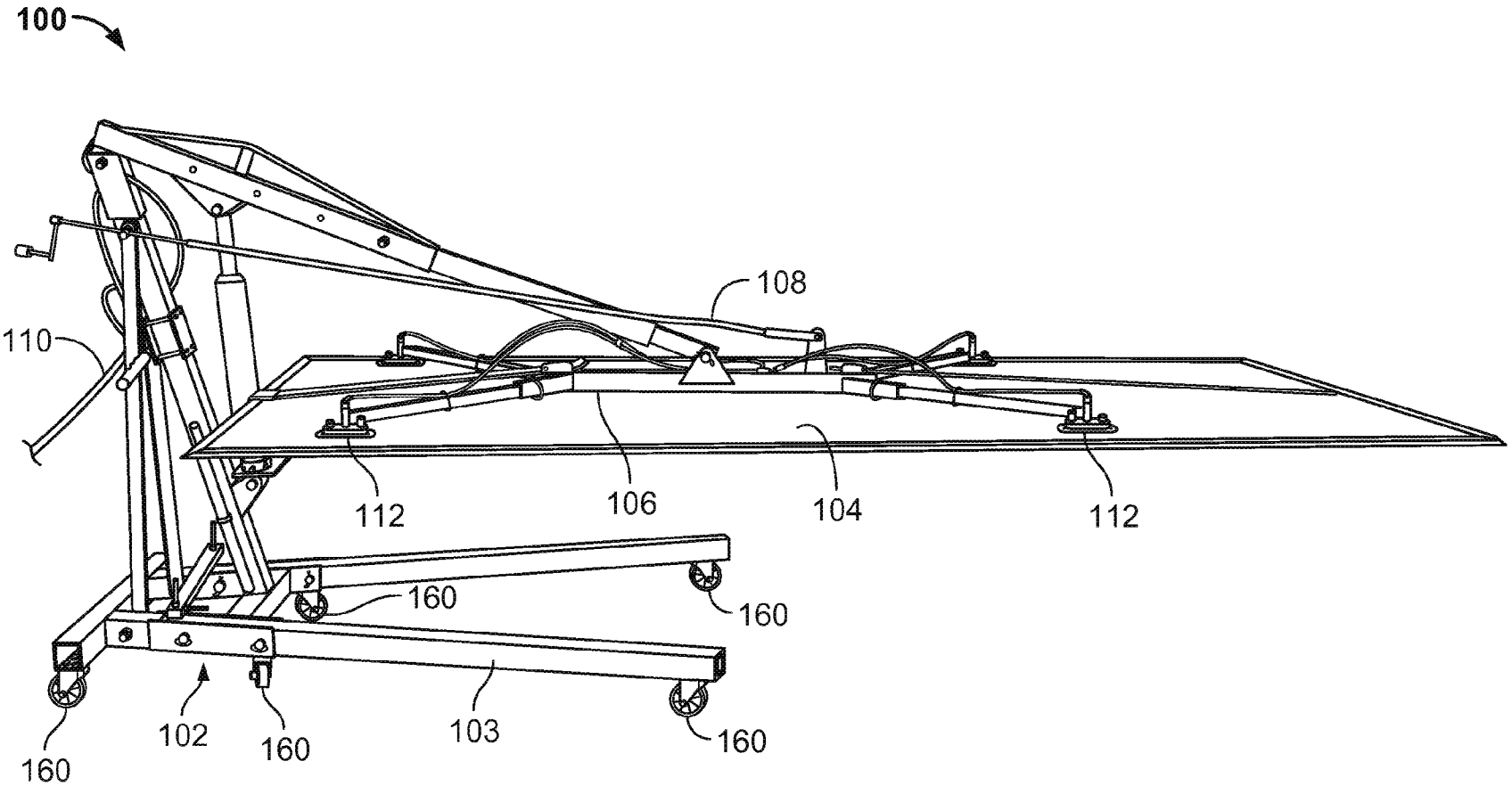
FIG. 1 shows a panel hoist holding a panel in accordance with one or more example embodiments.

FIG. 1 shows a panel hoist 100 holding a panel 104 in accordance with one or more example embodiments. As shown in FIG. 1, panel 104 is rectangular in shape, although other panels that panel hoist 100 can hold may be a shape other than rectangular. The rectangular panel 104 has a longitudinal axis extending between gripper clips. The rectangular panel 104 also has a transverse axis perpendicular to the longitudinal axis.

Panel hoist 100 includes a base 102. As shown in FIG. 1, base 102 includes base-elements, which, for example, can comprise rectangular steel tubes or pipes. Alternatively, base-elements can be made of a material other than steel, or can have a non-rectangular shape, such as a circular shape. Furthermore, instead of using tubes or pipes, base-elements can comprise solid (non-hollow) legs. Base-elements can be formed with or drilled to include holes in various locations to accept fasteners (e.g., screws or bolts) for connecting other elements of panel hoist 100 to base-elements.

Panel hoist 100 includes a hoist arm, and a hoist arm support to connect hoist arm to base 102. Panel hoist 100 can include stabilizers to stabilize hoist arm support. Stabilizer can attach to base-element 103 using a fastener, such as a bolt and nut. Stabilizer can be similarly attached to base-element.

Hoist arm support can be attached to base-element in any of a variety of manners. As an example, hoist arm support can be welded to base-element. As another example, hoist arm support can slide over or into an extender-element (not shown) extending from base-element. A fastener, such as a pin or clevis pin, can be positioned within holes in hoist arm support and the extender-element to secure hoist arm support to base-element.

Panel hoist 100 can comprise a jack 120 to raise hoist arm. Hoist arm support can include a jack support to support jack 120. Jack 120 can, for example, comprise a hydraulic jack, an air-over-hydraulic jack, or an electric-over-hydraulic jack. A jack can be used to lift items.

Panel hoist 100 includes a panel holder 106 configured for holding a panel, such as panel 104. Holding panel 104 can include holding the panel above the floor or ground on which panel hoist 100 is located. Panel holder 106 provides means for panel 104 to be removably attached to panel hoist 100. A panel holder, especially one used to hold doors, can be called a door holder.

Panel hoist 100 can include a rotator 108. Rotator 108 can include a handle and is configured for rotating panel holder 106 and a panel, such as panel 104, held by panel holder 106. Rotator 108 provides for maneuvering (e.g., rotating) panel 104 from a horizontal to a vertical position, from a vertical position to a horizontal position, or to any position between a vertical position and a horizontal position. Rotator 108 can be a called a crank assembly. Rotator 108 can be configured like rotator 1400 shown in FIG. 14.

Panel holder 106 can include attachment bracket. Attachment bracket can be welded or otherwise attached to panel holder 106. Attachment bracket can include or can be attached to a mechanical joint to which hoist arm attaches. For purposes of this description, that mechanical joint is referred to as a hoist arm mechanical joint. Hoist arm can be unattached from the hoist arm mechanical joint, the attachment bracket, and the panel holder 106. Hoist arm and attachment bracket can include one or more through-holes through which a fastener, such as a clevis pin or nut and bolt, can be inserted to secure the attachment of hoist arm to attachment bracket. The hoist arm mechanical joint can be configured as a knuckle joint. The hoist arm mechanical joint can include a bushing and rotatable roller pin. The roller pin can comprise a clevis pin. The roller pin can include a through-hole for placement of a cotter pin to retain the roller pin within an attachment hole or bushing. The mechanical joints described herein can be rotatable joints.

Panel holder 106 can include attachment bracket. Attachment bracket can be welded or otherwise attached to panel holder 106. Attachment bracket can include or can be attached to a mechanical joint to which rotator 108 attaches. For purposes of this description, that mechanical joint is referred to as a rotator mechanical joint. Rotator 108 can be unattached from the rotator mechanical joint, the attachment bracket, and the panel holder 106. Rotation of rotator 108 can cause rotator 108 to pivot about a component of the rotator mechanical joint. Rotator 108 and attachment bracket can include one or more through-holes through which a fastener, such as a clevis pin or nut and bolt, can be inserted to secure the attachment of rotator 108 to attachment bracket. The rotator mechanical joint can be configured as a knuckle joint. The rotator mechanical joint can include a bushing and rotatable roller pin. The roller pin can comprise a clevis pin. The roller pin can include a through-hole for placement of a cotter pin to retain the roller pin within an attachment hole or bushing.

Panel hoist 100 can include an air delivery system configured to receive supply air (e.g., compressed air) and to provide the supply air to various elements of panel hoist 100. Various air delivery system components are shown in the Figures and described herein. The air delivery system components shown and labeled in FIG. 1 include an air supply line and air supply inlet lines 114. The supply air, from an air compressor, can be provided to panel hoist 100 using air supply line.

Panel hoist 100 can include supplemental panel holders 116. Supplemental panel holders 116 can hold a panel above the floor or ground located beneath base 102. As an example, supplemental panel holders 116 and panel holder 106 can hold panel 104 in a given position in the event a supply of air to panel hoist 100 is reduced or eliminated. A supplemental panel holder can be called a supplemental door holder or by other names.

A supplemental panel holder 116 can include a gripper clip to clip to an end of panel 104, a strap connected to gripper clip, and ratchet buckle removably attachable to panel holder 106. Ratchet buckle can include a ratcheting tensioning mechanism and a tensioning mechanism lever to take up any slack (e.g., adjust) in strap. Gripper clip can comprise a hook, such as a flat hook. Strap can comprise a winch strap or another type of strap. In alternative arrangements, supplemental panel holders 116 can include a cable, rope, or another suitable element in place of a strap.

As shown in FIG. 1, two supplemental panel holders are attached to opposite ends of a portion of panel holder 106, and straps extend from panel holder 106, along a longitudinal axis of panel 104, towards opposing ends of panel 104. Additionally or alternatively, straps of other supplemental panel holders (not shown) can extend from panel holder 106, along a transverse axis of panel 104 (i.e., an axis perpendicular to the longitudinal axis), towards other opposing ends of panel 104.

Panel hoist 100 can comprise a plurality of castors 160 connected to base 102. One or more of castors 160 can comprise a swivel castor that is vertically rotatable to make panel hoist 100 easier to maneuver. Maneuvering panel hoist 100 can include rolling panel hoist 100 across a floor. One or more of castors 160 can comprise a fixed castor that cannot be vertically swiveled when attached to base 102. The fixed castor(s) can provide directional stability of panel hoist 100. Panel hoist 100 can comprise a castor (not shown), similar to castor 160 connected to base-element, connected near an end of base-element opposite the end of base-element at which castor 160 is shown in FIG. 1. Castors 160 can be connected to base 102 using fasteners (e.g., bolts or screws), by welding a portion of the castor to base 102, or using some other means.

In accordance with one or more example embodiments, panel hoist can include a base device that includes two or more of the panel hoist components shown in FIG. 1. The base device can comprise a lifting device, such as an automobile engine lift, that includes the two or more panel hoist components. An automobile engine lift can comprise an engine lift with a capacity of lifting two tons (i.e., 4,000 pounds) or some other capacity. An engine lift can be called a cherry picker. An engine lift with a two ton capacity can be called a two ton engine lift or a two ton rolling engine lift. An engine lift can include a hydraulic jack, an air over hydraulic pump jack, an electric-over-hydraulic jack, or another type of jack.

Figure 4:
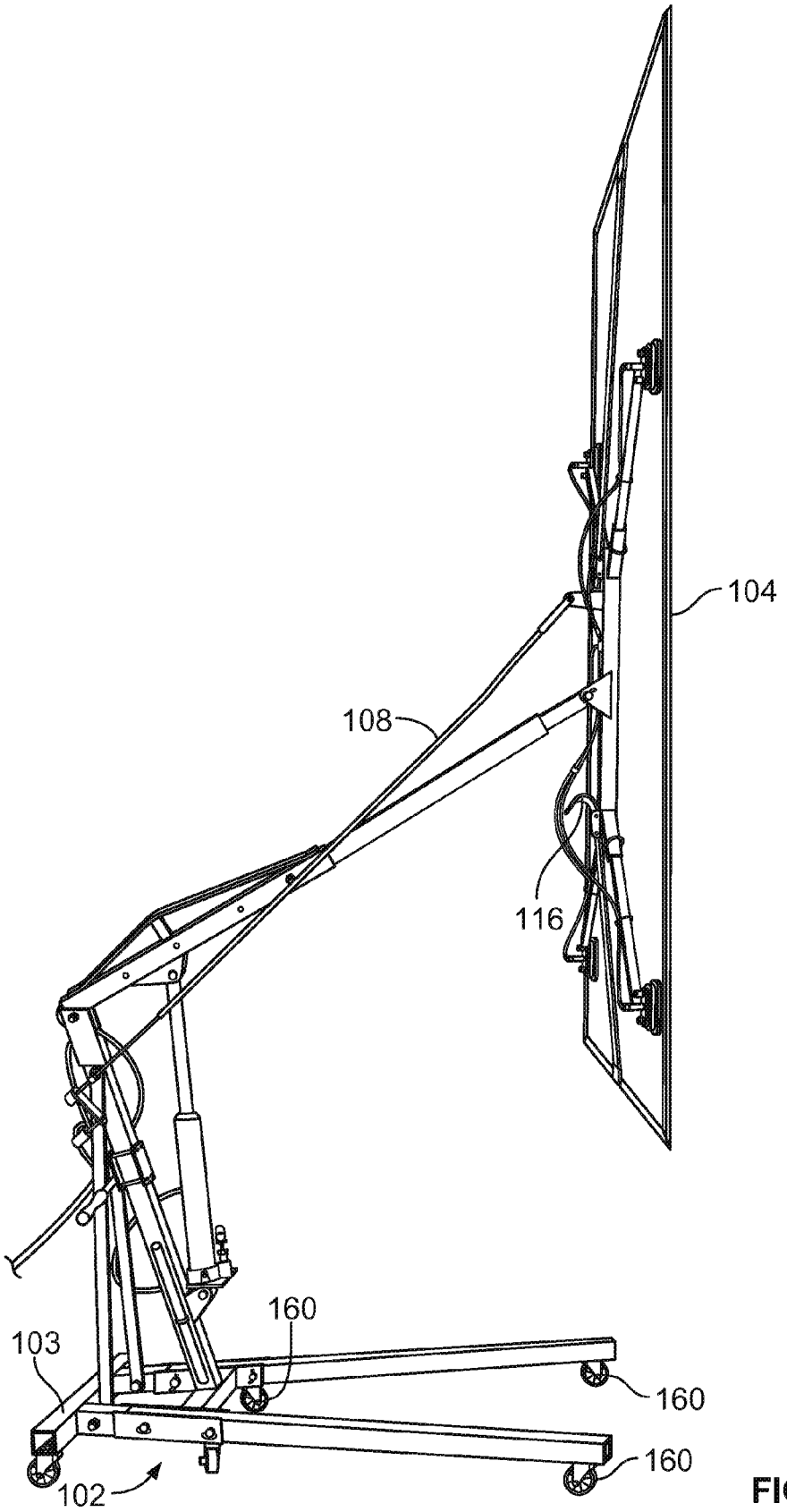
FIG. 4 shows a panel hoist holding a panel in accordance with one or more example embodiments.
Figure 5:
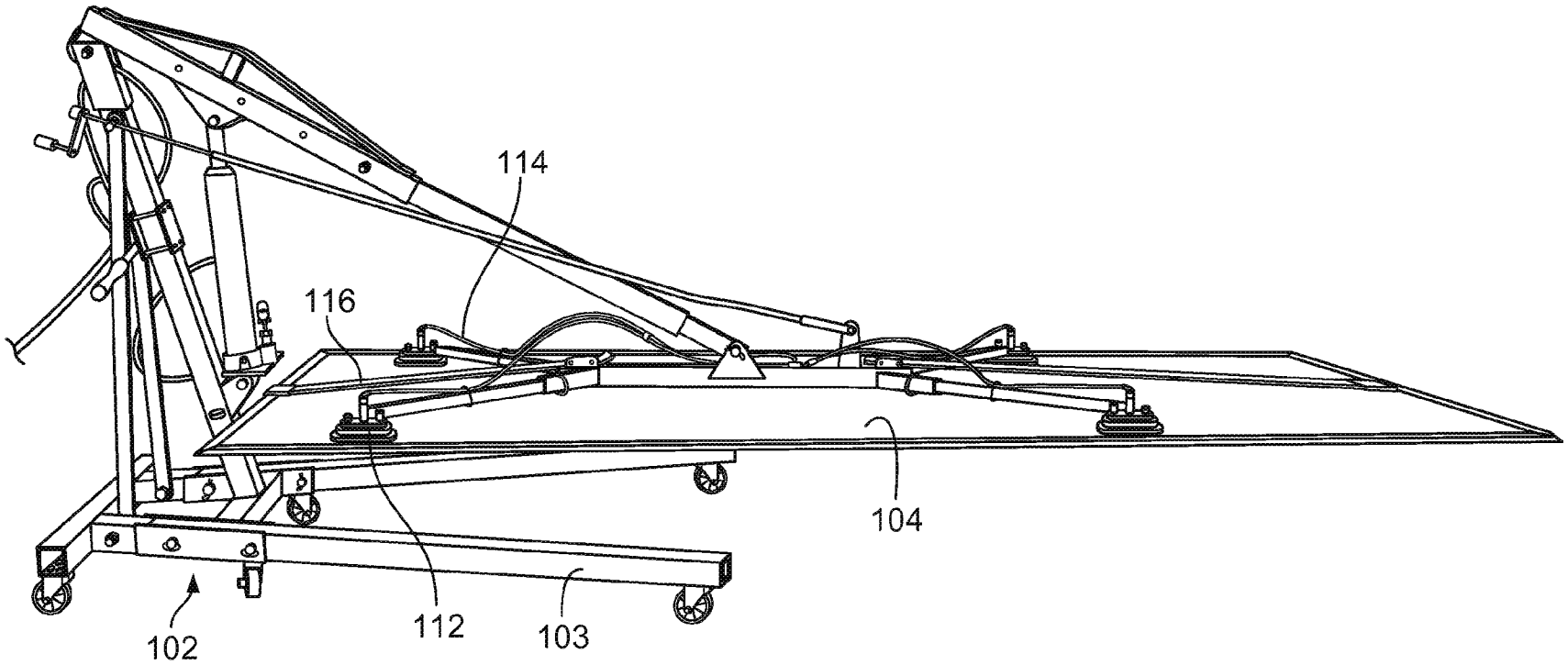
FIG. 5 shows a panel hoist holding a panel in accordance with one or more example embodiments.

Turning to FIG. 5, FIG. 5 shows additional details of panel hoist 100 and shows panel hoist 100, panel holder 106, and supplemental panel holder 116 holding panel 104 above a floor or the ground on which panel hoist 100 is positioned. A person comparing FIG. 1 to FIG. 5 would see that the position of panel 104 in FIG. 5 is closer to the floor or the ground relative to the position of panel 104 with respect to the floor or ground as shown in FIG. 1.

The lower position of panel 104 in FIG. 5 provides for showing additional details of jack 120. As shown in FIG. 5, jack 120 includes a handle bracket, a release valve, a jack ram (e.g., a hydraulic piston), and a jack base. Jack base can be attached to jack support. Ram can be attached to hoist arm. Panel hoist 100 can comprise a jack handle to insert into handle bracket for operating a pump plunger (not shown) of jack 120. Supply air, provided to an air motor of an air-over-hydraulic jack, can be used to raise ram and hoist arm. In an alternative arrangement, supply air can be provided by an electric powered air compressor (not shown), to the air motor and to the suction cups and air delivery system described elsewhere herein. The electric powered air compressor can connect to an alternating current (AC) voltage source, such as voltage source supplying 110 volts AC.

As mentioned above, hoist arm support can slide over or into an extender-element extending from base-element. FIG. 5 shows an extender-element into which a portion of hoist arm support has been positioned. The fasteners that can be used to retain hoist arm support within extender-element are not shown.

One or more base-elements 103 can comprise multiple base-element segments. The base-element segments of each base-element can attach to one another to form a complete base-element. The base-element segments can be detached from one another during disassembly of the base-element and panel hoist 100. As shown in FIG. 5, base-element 103 includes base-element segments. As an example, a portion of base-element segment can be positioned within base-element segment. As another example, a portion of base-element segment can be positioned within base-element segment. One or more fasteners, such as fasteners can be inserted within base-element segments to retain those segments together. Support elements can abut base-element segments to retain those segments together. Base-element 109 can be configured similar to base-element 103.

Figure 2:
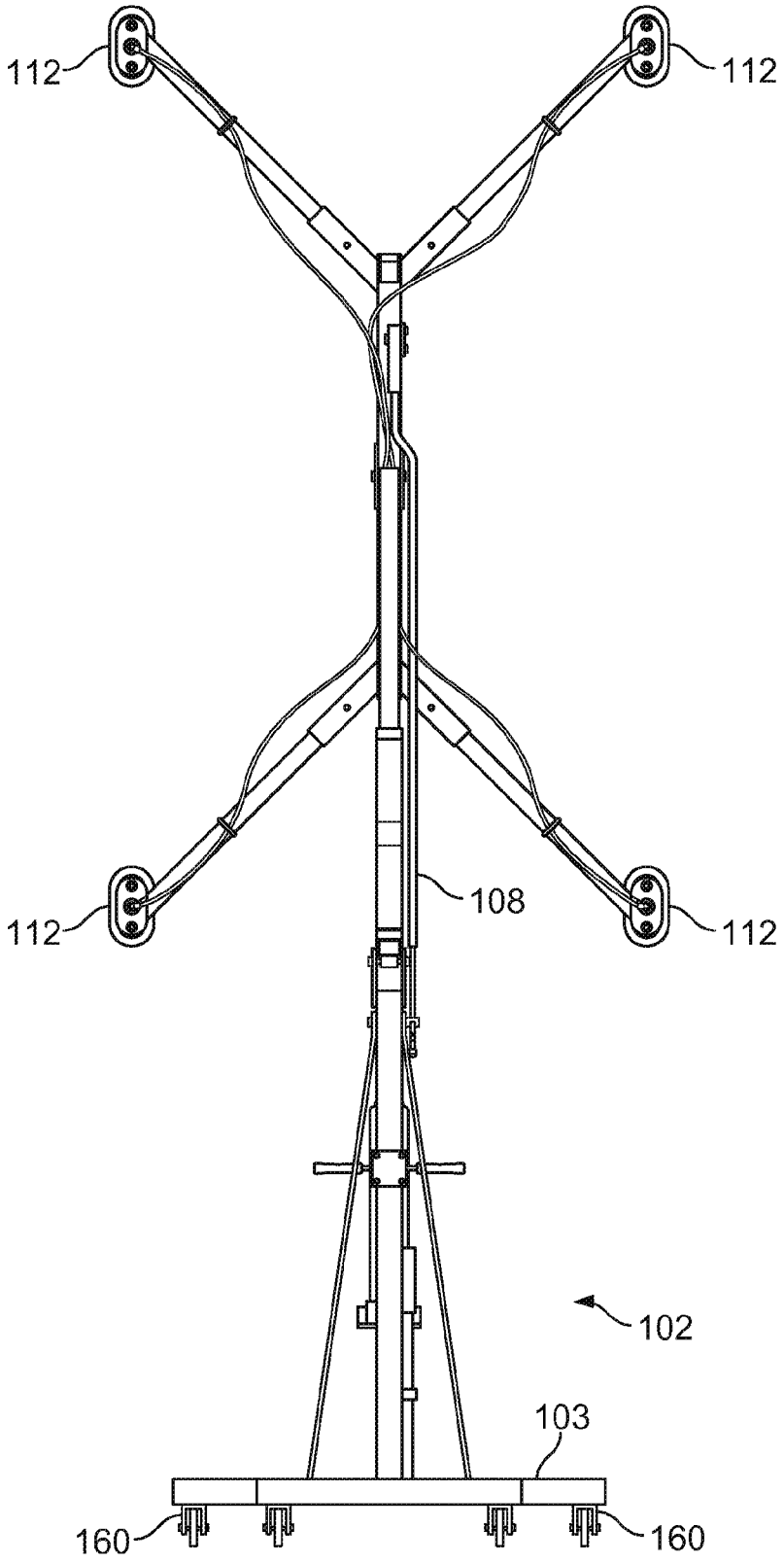
FIG. 2 shows a panel hoist holding a panel in accordance with one or more example embodiments.
Figure 3:
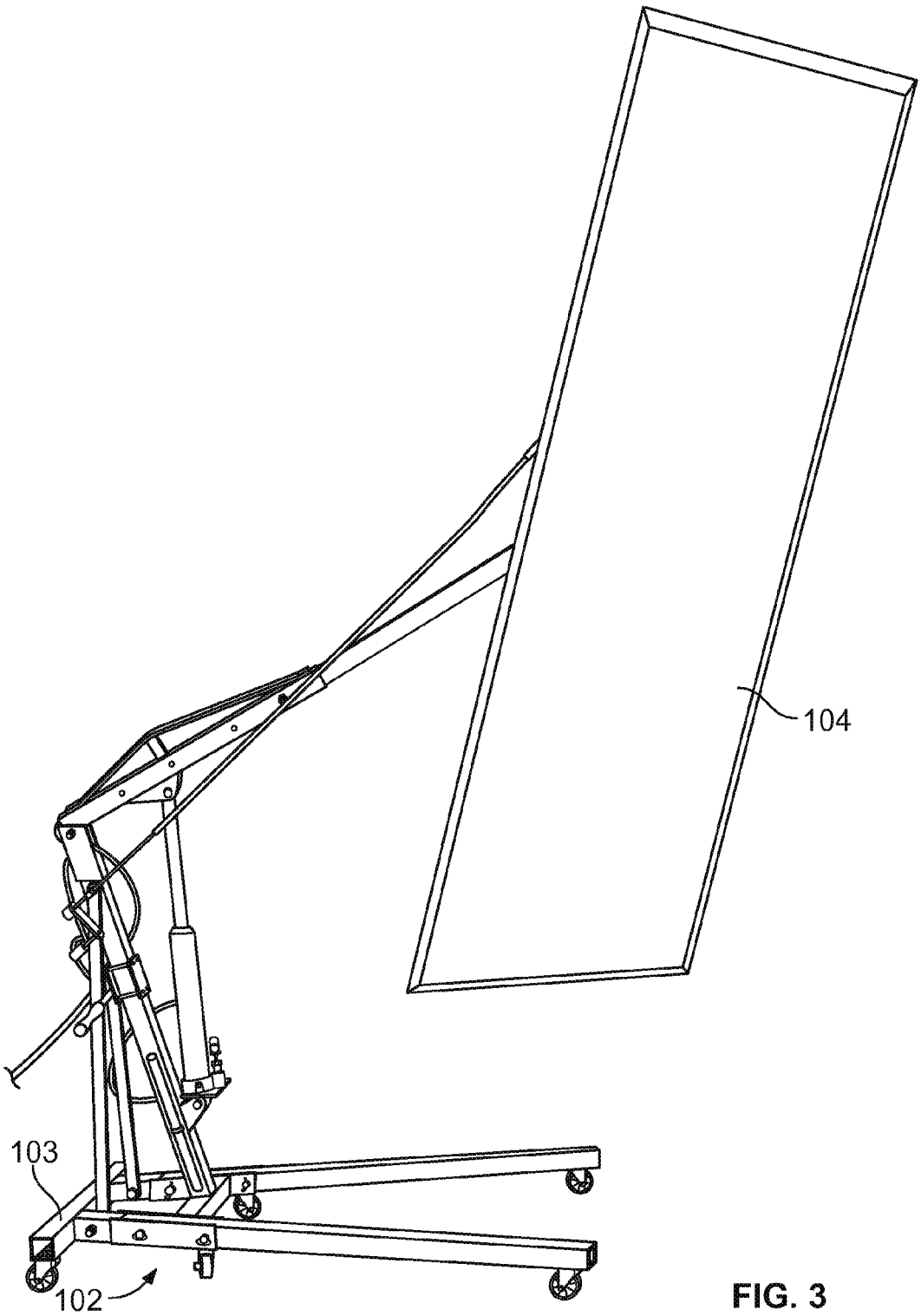
FIG. 3 shows a panel hoist with a panel holder in an elevated position relative to a lowest position of the panel holder.

Turning to FIG. 2, FIG. 2 illustrates panel hoist 100 without panel 104, but with panel holder 106 in an elevated and rotated position relative to the position of panel holder 106 as shown in FIG. 1 and FIG. 5. FIG. 2 shows handles attached to hoist arm support. Handles can be used for maneuvering panel hoist 100. Handles provide for pushing and pulling of panel hoist 100.

FIG. 2 also shows an alternative arrangement of panel holder 106 in which panel holder 106 includes flanges proximate to suction cups 112 or otherwise. Each flange can comprise a through-hole. In the event a panel to be held is damaged such that one or more suction cups 112 cannot be attached to the damaged panel, bolts or other fasteners can be placed through the flange holes and holes in the damaged panel and secured with nuts to attach the damaged panel to panel hoist 100. As an example, the damaged panel can comprise a damaged door to be removed from a van or trailer. The damaged panel can subsequently be lowered from its mounted position, removed from panel hoist 100, and then a replacement panel can be attached to panel hoist 100, raised to a mounting position, and attached to the van or trailer the panel in place of the damaged panel.

Turning to FIG. 4, FIG. 4 illustrates panel hoist with panel 104 and panel holder 106 in an elevated and rotated position relative to the position of panel holder 106 as shown in FIG. 1 and FIG. 2. FIG. 4 shows labels for defining portions of panel 104. In that regard, panel 104 includes a first end, a second end, a third end, and a fourth end. First end can be called a top. Second end can be called a bottom.

As shown in FIG. 4, as compared to FIG. 1, ram has been extended to raise hoist arm such that panel 104 has been raised from its initial height, and rotator 108 has been turned to rotate panel 104 such that its longitudinal axis is substantially perpendicular to the floor or ground upon which base 102 is positioned. The longitudinal axis extends from first end to second end. The transverse axis of panel 104 extends from third end to fourth end.

Turning to FIG. 4, FIG. 4 illustrates panel hoist with panel 104 and panel holder in an elevated and rotated position relative to the position of panel holder 106 as shown in FIG. 1 and FIG. 5. Suction cups 112, supplemental panel holders 116, and gripper clips holding panel 104, all of which are discussed above, are identified in FIG. 2.

As shown in FIG. 4, hoist arm can comprise multiple hoist arm segments. Two of the hoist arm segments can attach to one another to form a larger portion of hoist arm. Hoist arm segment includes fastener slots and another fastener slot in which a fastener is inserted. Fastener can, for example, comprise a clevis pin and retainer pin, or a bolt and nut. A portion of hoist arm segment can be positioned within hoist arm segment. While in that position, an end of hoist arm segment can be located between fastener slot and fastener. To change a length of hoist arm, after removing fastener, the end of hoist arm segment can be slid to another portion within hoist arm segment and fastener can be placed within another fastener slot within hoist arm segment to fasten hoist arm segment to hoist arm segment.

Hoist arm segments can be welded together. Alternatively, each of those hoist arm segments can include fastener slots, usable with a fastener, to adjust a length of a portion of hoist arm formed by hoist arm segments.

Figure 6:
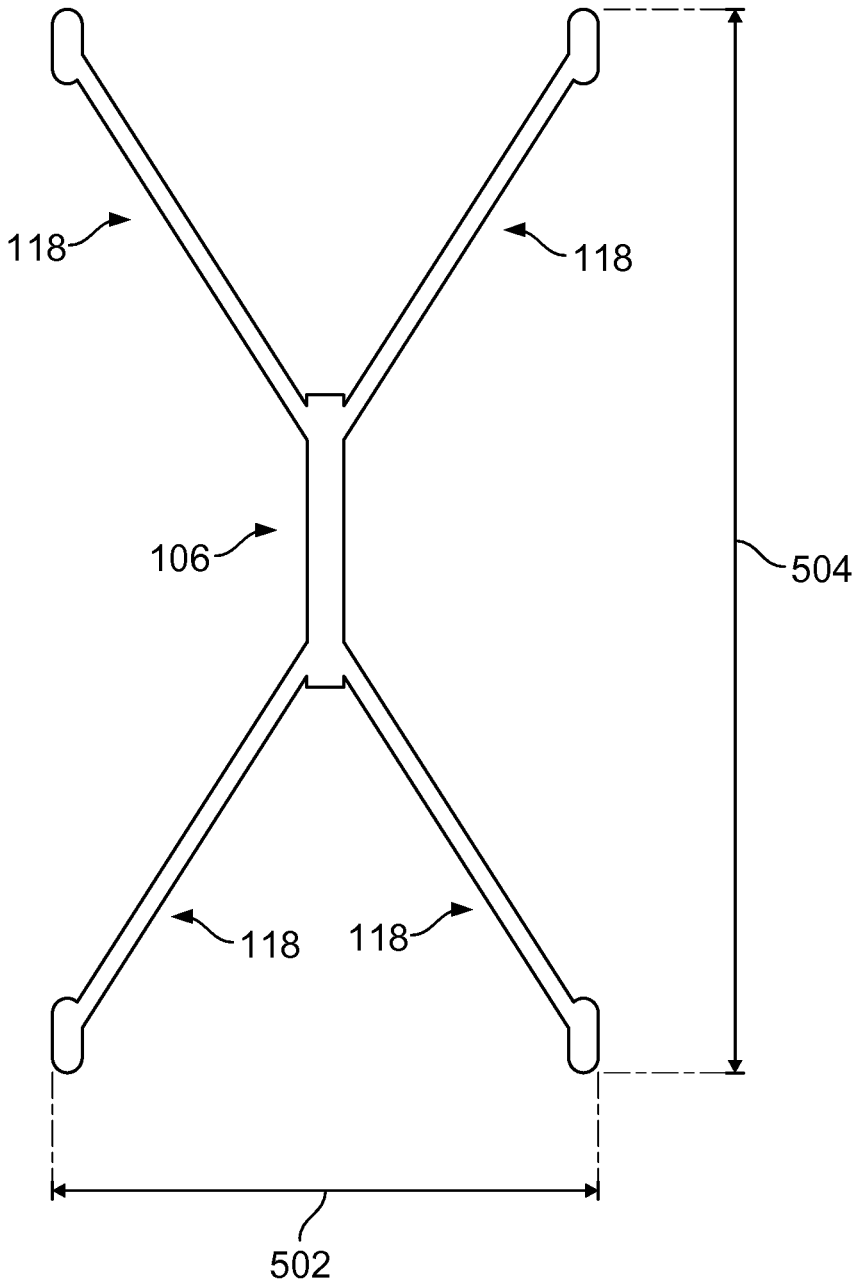
FIG. 6 shows a panel holder configuration in accordance with one or more example embodiments.

Turning to FIG. 6, FIG. 6 shows an example X-frame configuration (or more simply, "X-frame") of panel holder 106. X-frame configuration includes four arms 118 extending from a common center portion. A suction cup can be positioned at or proximate to a distal end of each arm 118 relative to the common center portion. Panel hoist 100 can use four air-actuated suction cups 112. As an example, each suction cup can comprise a 2.5 inch by 5 inch suction cup. Other example sizes of the suction cups are also possible. The suction cups positioned on each arm 118 can be configured like suction cups 112 identified in FIG. 1, FIG. 2, and FIG. 5. Panel holder 106, using X-frame configuration, can attach to hoist arm using attachment bracket, as described herein.

X-frame configuration can be configured to be removably attachable to an end of an engine lift.

FIG. 6 shows panel holder 106 having dimensions 502 and 504. As an example, dimension 504 can be 72 inches and dimension 502 can be 44 inches. Other examples of dimensions 502 or 504 are also possible. In that regard, for example, an arm 118 can comprise a telescoping arm to increase or decrease a length of the arm. To shorten the arm, a first portion of the arm 118 can slide into a second portion of the arm. A pin or other device can be inserted into holes within the first and second portions of arm 118 to keep arm 118 at a fixed length until the length of arm 118 is readjusted. To lengthen arm 118, the first portion of arm 118 can be pulled out of the second portion of arm 118. The pin or other device can be inserted into holes within the first and second portions of arm 118 to keep arm 118 at another fixed length until the length of arm 118 is readjusted.

A person having ordinary skill in the art will understand that panel holder 106 can be arranged in any of a variety of configurations including configurations other than X-frame configuration. At least one of those other configurations can comprise a configuration with a number of arms other than four arms.

Figure 7:
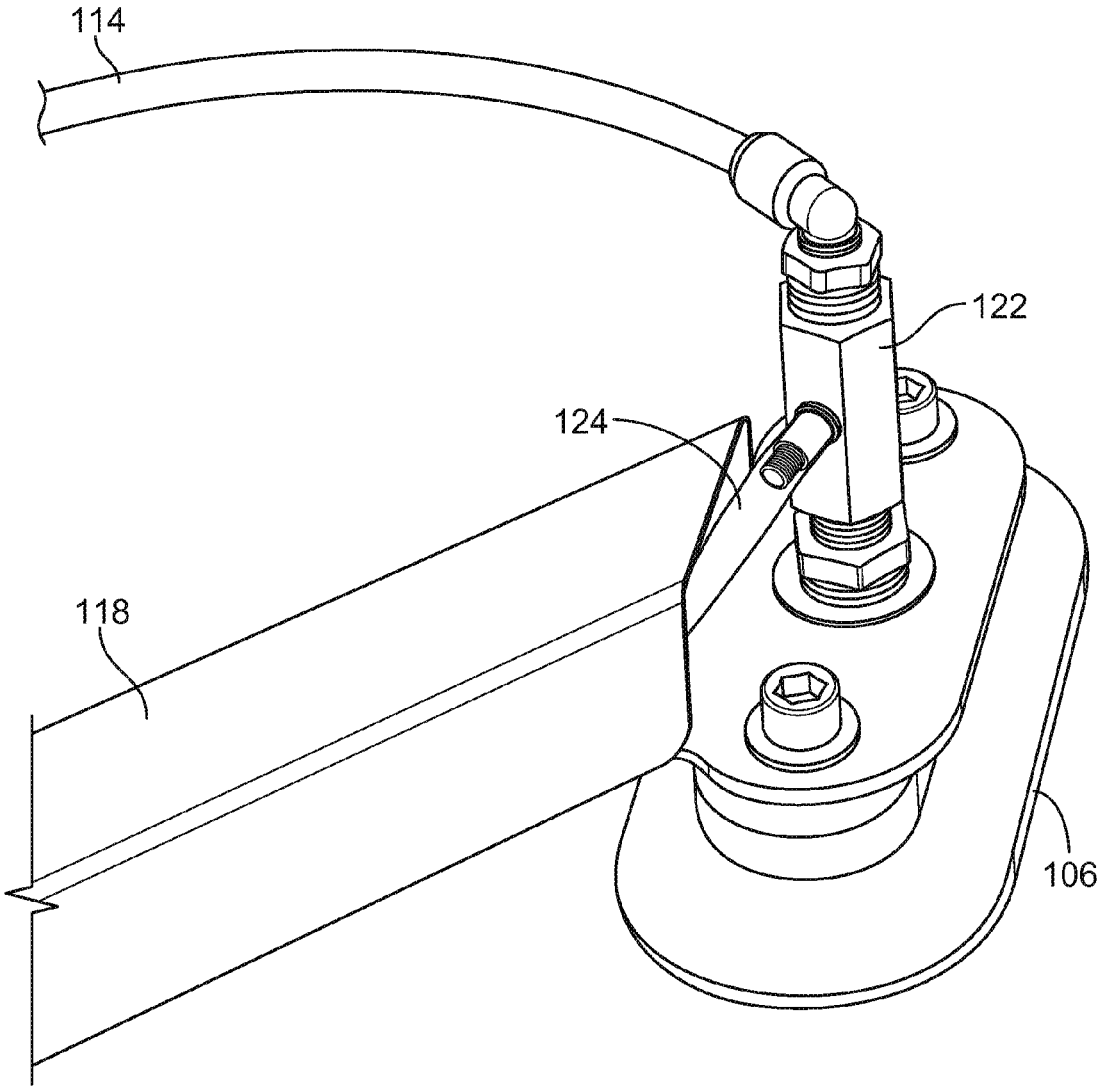
FIG. 7 shows details of a panel holder in accordance with one or more example embodiments.

Turning to FIG. 7, FIG. 7 shows details of panel holder and arm 118 in accordance with one or more example embodiments. Any or all of arms 118 shown in FIG. 6 may be arranged as shown in FIG. 7. FIG. 7 shows a distal end of arm 118, a suction cup mounting portion, a suction cup attached to suction cup mounting portion using fasteners, and a venturi vacuum device 122 attached to a venturi vacuum device mounting area 708 of suction cup mounting portion. Fasteners can comprise any of a variety of fasteners.

An air supply inlet line 114 provides supply air to a venturi vacuum device 122. An air return line 124 is connected to venturi vacuum device 122 to remove supply air exiting venturi vacuum device 122. Air supply inlet line 114 and venturi vacuum device 122 can be components of the air delivery system described herein.

Suction cup 112 can comprise an air actuated 27 Hg vacuum suction cup. Each suction cup 112 can be rated at 117 pounds of lifting force. Supply air, such as compressed air provided by a shop air compressor of the air delivery system, can be provided to an air pump to create a vacuum at the suction cups to secure the suction cups to the door. Using an air over hydraulic pump, an arm of panel hoist 100 can be raised, with panel 104 attached to panel holder 106, to a position at which panel 104 can be rotated using rotator 108 from a horizontal or substantially horizontal position to a vertical or substantially vertical position.

Figure 8:
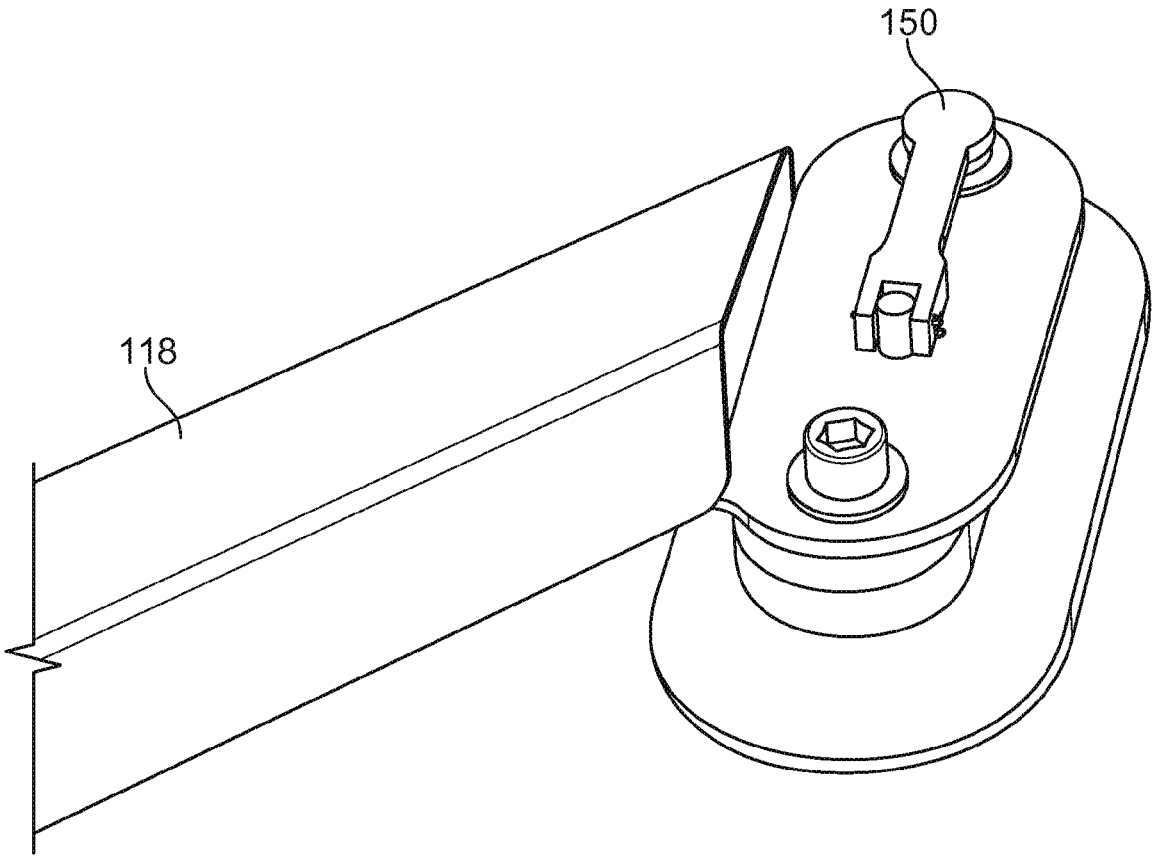
FIG. 8 shows details of a panel holder in accordance with one or more example embodiments.

Turning to FIG. 8, FIG. 8 shows details of panel holder and arm 118 in accordance with one or more example embodiments. Any or all of arms 118 shown in FIG. 6 may be arranged as shown in FIG. 8. FIG. 8 shows a distal end of arm 118, a suction cup mounting portion, a suction cup attached to suction cup mounting portion using fasteners, and a mechanical lever 150 attached to a lever mounting area of suction cup mounting portion. Fasteners can comprise any of a variety of fasteners. Mechanical lever 150 can be configured for securing suction cup to panel 104, and releasing a suction cup that is secured to panel 104. The arrangement of suction cup 112 can be referred to as a manual suction cup. A manual suction cup does not require use of electricity or a compressed air supply to apply the suction cup to a panel to be held by panel hoist 100.

Figure 9:
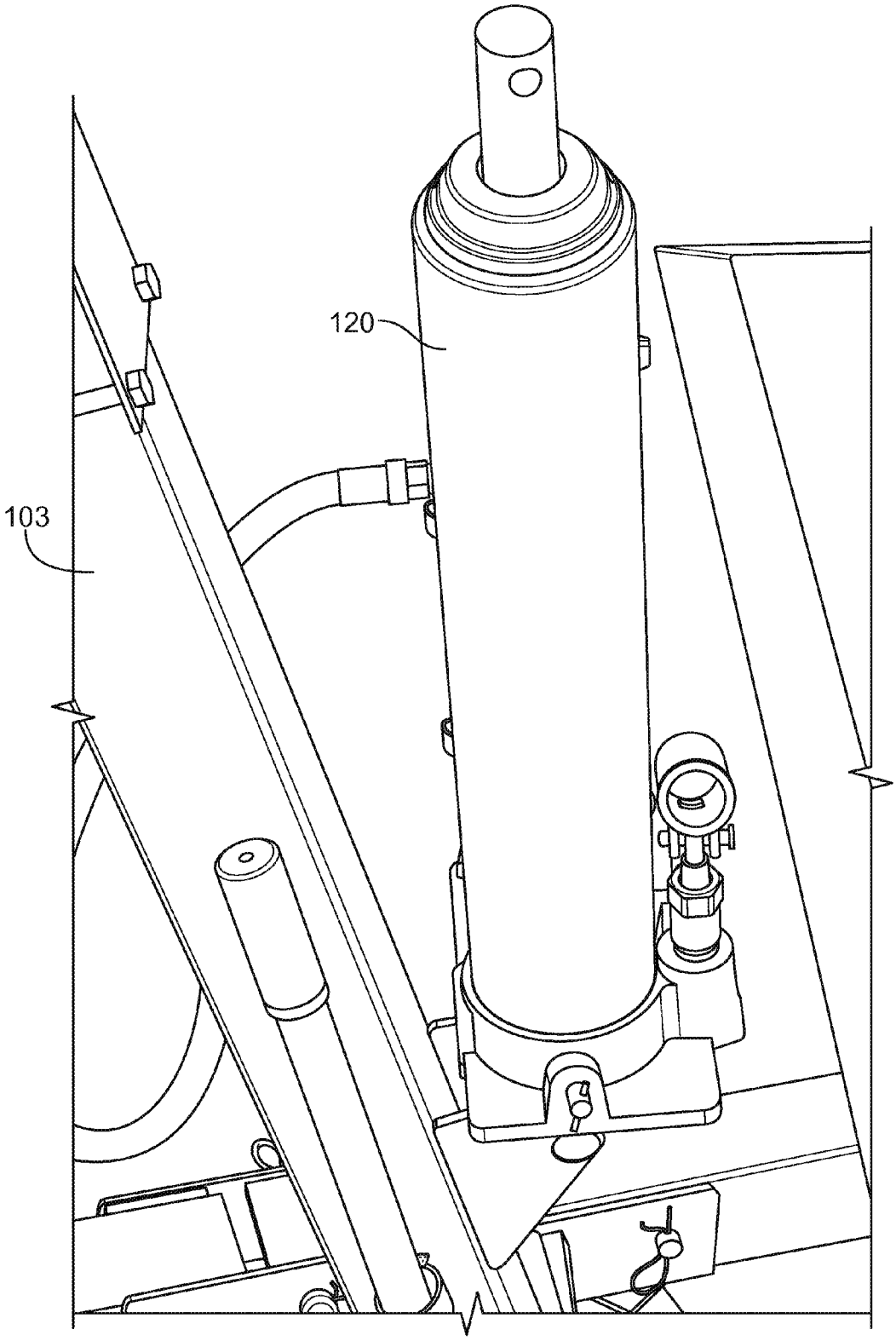
FIG. 9 shows details of a panel hoist in accordance with one or more example embodiments.
Figure 10:
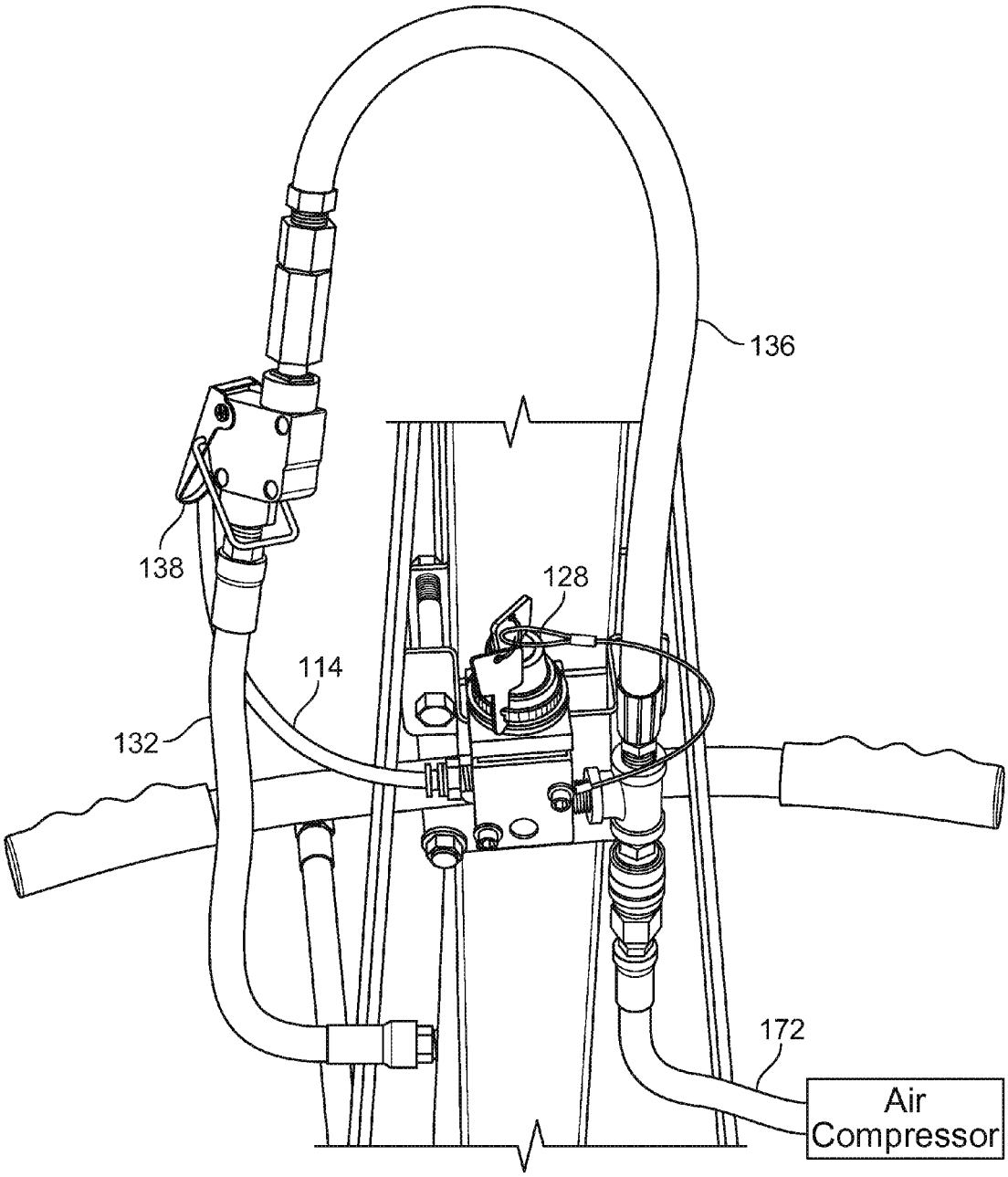
FIG. 10 shows additional details of a panel hoist in accordance with one or more example embodiments.

Turning to FIG. 9, FIG. 9 shows details of panel hoist including base-element, hoist arm support 103, jack handle, handle bracket, jack 120, release valve, jack support 127, and ram 194. FIG. 9 shows jack 120 as an air over hydraulic jack including air motor. The air motor can include or work in combination with an air over hydraulic pump to raise ram. The air supply line 132 shown in FIG. 10 is shown in FIG. 9 leading to jack 120. In accordance with other embodiments, the jack can be limited to a hydraulic jack. As shown in FIG. 9, base-element includes base-element segments, support elements, and fasteners to retain base-element segments to support elements until disassembly of base-element 109.

Turning to FIG. 10, FIG. 10 shows example components of panel hoist and, in particular, air delivery system components of panel hoist 100. FIG. 10 shows hoist arm support, stabilizers, and handles to show example locations at which various air delivery system components can be attached to panel hoist 100.

The air delivery system can include air supply line that is removably attachable to an air compressor. The air delivery system can include air supply line fittings. Air supply line fitting provides a means to connect panel hoist 100 to a source of compressed air (e.g., air compressed above the ambient air pressure), such as air compressor. As an example, air compressor can provide compressed air between a range of 125 to 180 pounds per square inch. Other example air pressures are also possible.

The air delivery system can include a keyed switch 128 to switch the supply of air to venturi vacuum devices 122 (shown in FIG. 7) at each suction cup 112 by way of air supply inlet lines 114, and to air motor of an air-over-hydraulic jack 120 (shown in FIG. 9). The use of the keyed switch or another safety switch can help to avoid removal of supply air to venturi vacuum devices 122 and air motor of an air-over-hydraulic jack 120, including when panel 104 is raised above the ground.

The air delivery system can include an air control switch 138 connected to air supply lines 132 and 136. Supply air provided to air supply line 136 can flow to air control switch 138. Air control switch 138 can be used to supply air to air motor by way of air supply line 132 so as to raise ram of jack 120.

The air delivery system can include can include an air pressure regulator to control an amount of air pressure provided to various components of the air delivery systems, such as venturi vacuum devices 122 or air motor.

III. Panel Hoist Disassembly

Various components of panel hoist 100 have been described as being attached or connected to each other. Some or all of those attached components and other components of panel hoist 100 can be unattached or disconnected from each other and subsequently re-attached or re-connected multiple times. The disassembly of panel hoist 100 provides for easier shipment of panel hoist 100 in the event panel hoist 100 needs to be shipped.

Figure 12:
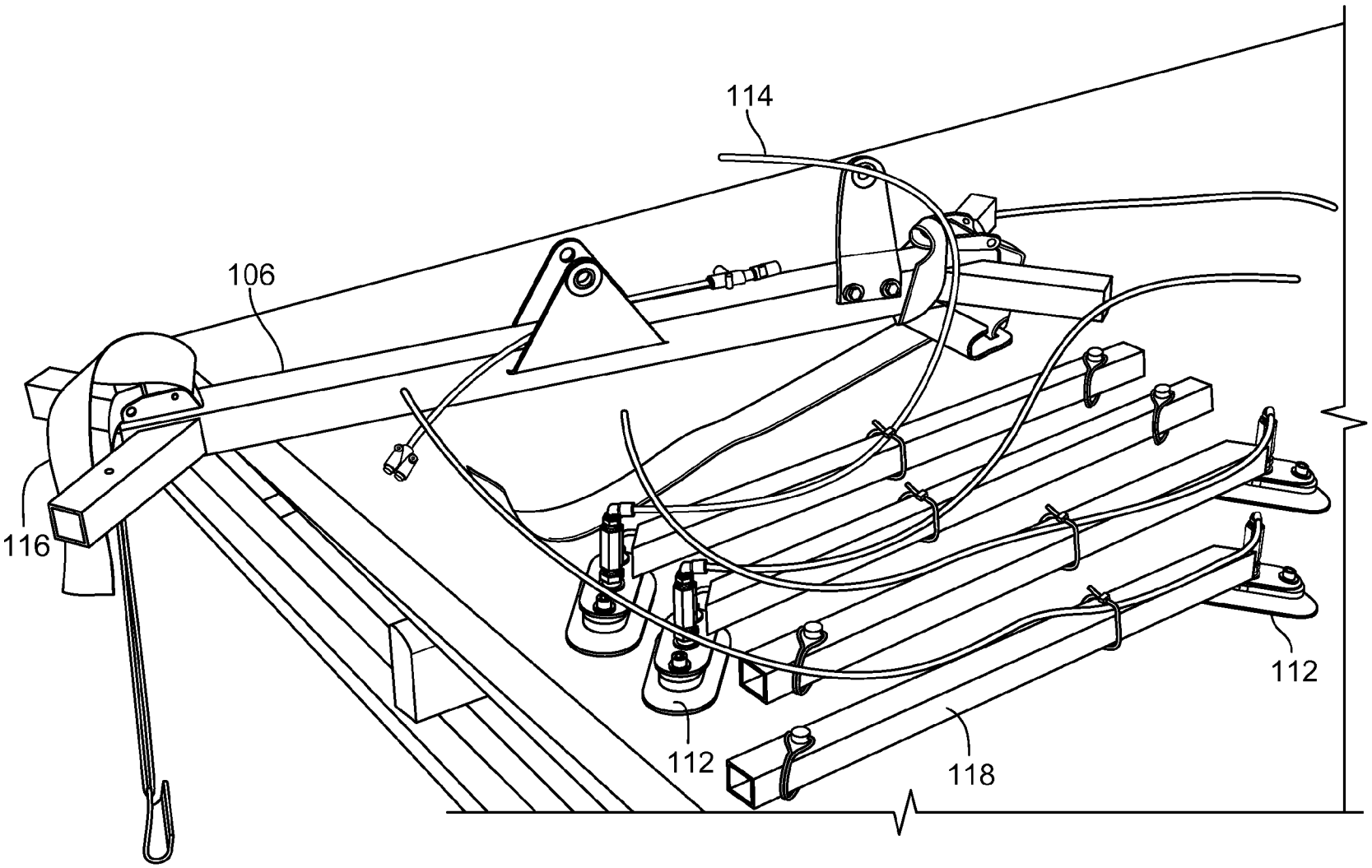
FIG. 12 shows a panel hoist in an example configuration for shipment of the panel hoist.

Turning to FIG. 12, FIG. 12 shows various components of panel holder 106 in accordance with one or more example embodiments in which panel holder 106 can be disassembled and reassembled. As shown in FIG. 12, panel holder 106 includes a bracket body. Bracket body includes branches and attachment brackets. Attachment bracket includes bracket segments, both of which can include a bushing. Attachment bracket can include a bushing.

Branches can include attachment holes for receiving a fastener for attaching or retaining a branch extender to a branch of bracket body. Branches can include an external surface and an inner portion. Similarly, branch extender can include an external surface and an inner portion. In one respect, an end of branch extender opposite suction cup 112 can be placed within an inner portion of a branch. In another respect, a distal end of a branch, relative to bracket body, can be placed within an inner portion of a branch extender. Bracket body, branches and branch extenders can have rectangular cross-sections, as shown in FIG. 12, or a non-rectangular cross-section.

Each branch can include one or more attachment holes (two of which are shown in FIG. 12). Each branch extends away from bracket body such that panel holder 106 is configured like the letter "X." That configuration can be referred to as an "X-frame configuration."

Each branch extender includes a suction cup 112, a venturi vacuum device 122, a branch extender fastener, a retainer strap, and an attachment hole (not shown because branch extender fasteners are located within those attachment holes). As an example, each fastener can comprise a rounded retainer locking pin having a 0.25 inch diameter and a length of 2.5 inches, or some other type of fastener. The fastener can include a through-hole for installing a cotter pin or other fastener retainer. Retainer straps can be attached to branch extender to reduce the likelihood or prevent separation of branch extender fastener from its respective branch extender.

FIG. 12 shows other components of panel holder 106 or other components that attach to or that are associated with panel holder 106. Those other components include air supply inlet lines 114, air supply inlet line retaining straps, supplemental panel holders 116, air line fittings for connecting segments of air supply inlet lines 114 or other components of the air delivery system, and gripper clips.

Figure 11:
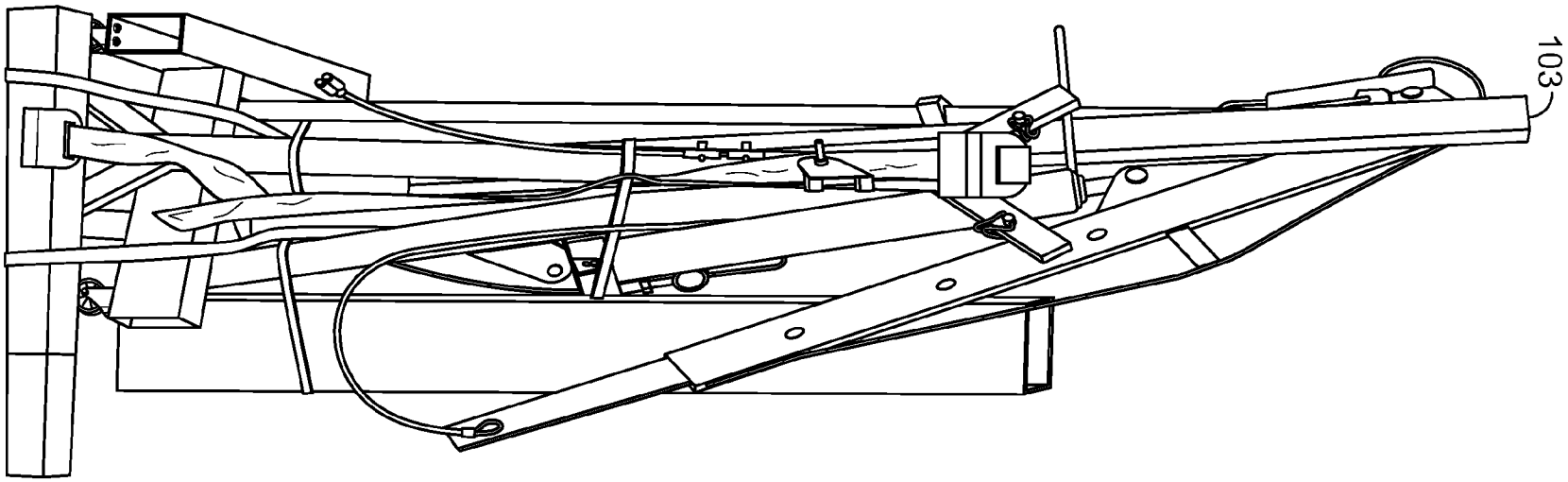
FIG. 11 shows additional details of a panel holder in accordance with one or more example embodiments.

Turning to FIG. 11, FIG. 11 shows panel hoist 100 in a disassembled state and attached to a shipping element, such as a wooden pallet. Mounting straps can be used to keep the disassembled components of panel hoist 100 strapped together for shipment of panel hoist 100. The various components identified in FIG. 11 are discussed with respect to other similarly numbered components in other figures.

IV. Example Kits

In accordance with the example embodiments described herein, a variety of kits comprising components of a panel hoist can be arranged. In one respect, the kit components can be assembled to form a panel hoist. In another respect, the kit components can be assembled to form one or more panel hoist elements of a panel hoist. Various portions of the kits can be combined and packaged as separate kits.

As an example, a kit can comprise panel holder 106, a plurality of suction cups 112 connected to or adapted for connection to panel holder 106, rotator 108, a first rotatable joint adapted to be connected to panel holder 106 and to a hoist arm of a hydraulic engine lift, and a second rotatable joint adapted to connect rotator 108 to panel holder 106.

Panel holder 106 of the kit can include attachment bracket including the first rotatable joint. Panel holder 106 of the kit can include attachment bracket including the second rotatable joint.

Rotator 108 of the kit can comprise a shaft including a first shaft segment and a second shaft segment. The first shaft segment can include a first end and a second end. The first end of the first shaft segment includes a first threaded portion. The second shaft segment can include a first end and a second end. The first end of the second shaft segment includes a second threaded portion configured to engage the first threaded portion of the first shaft segment. The second end of the second shaft segment is configured for connection to the second rotatable joint.

The example kit can include a secondary panel holder that connects to panel holder 106. The secondary panel holder can be arranged like secondary panel holder 116. The secondary panel holder can be connected to panel holder 106. The secondary panel holder can comprises a first strap, a second strap, a first ratchet tensioner, and a second ratchet tensioner. The first ratchet tensioner and the second ratchet tensioner can be attached to panel holder 106. A first portion of the first strap is attachable to the first ratchet tensioner and a second portion of the first strap includes a first hook configured for contacting a panel. A first portion of the second strap is attachable to the second ratchet tensioner and a second portion of the second strap includes a second hook configured for contacting the panel. The first ratchet tensioner is operable to increase tension on the first strap. The second ratchet tensioner is operable to increase tension on the second strap.

The example kit can include the hydraulic engine lift.

The example kit can include hoist arm or any portion of hoist arm for attachment to the hydraulic engine lift without including the hydraulic engine lift within the kit.

The example kit can include an air-over-hydraulic jack.

The example kit can include an electric-over-hydraulic jack.

The example kit can include an air delivery system including any one or more air delivery components described herein.

One or more suction cups of the kit can be arranged like suction cup shown in FIG. 7.

One or more suction cups of the kit can be arranged like suction cup shown in FIG. 8.

The example kit can include base 102, hoist arm, and hoist arm support.

The example kit can include fasteners for attachment or retaining segments of base 102, hoist arm, hoist arm support, and panel holder 106 together.

The example kit can include fasteners for attaching rotator 108 to hydraulic engine lift.

The example kit can include any component as shown in the figures or as described herein. The components of the example kit can be unassembled, at least partially, for shipment of the kit similar to components shown in FIG. 12.

V. Example Uses

Example operations performable using the example panel hoists were discussed previously. Now, more particular example operations performable using an example panel hoist are discussed.

A panel hoist, in accordance with one or more example embodiments, can be used to hold a panel while the panel is painted or prepared in some other manner prior to attachment of the panel to a panel attachment item (for example, a wall or a semi-tractor trailer).

A panel hoist, in accordance with one or more example embodiments, can be used to hold a door panel as door hardware, such as hinges, handles, or locks, is attached to the door panel.

A panel hoist, in accordance with one or more example embodiments, can be used to lift and then hold a door panel in a desired position as the door panel is attached to a semi-tractor trailer.

A panel hoist, in accordance with one or more example embodiments, can be used to lift and then hold a side panel in a desired position as the side panel is attached to a semi-tractor trailer.

A panel hoist, in accordance with one or more example embodiments, can be attached to a panel prior to removal of the panel from a panel attachment item to which the panel is attached and pulled away from the item. Thereafter, the panel hoist can be used to lower the removed panel from a first position to a second position (lower than the first position).

A panel hoist, in accordance with one or more example embodiments, can be used to lift and then hold a board in a desired position as the board is attached to a wall or other structure.

A panel hoist, in accordance with one or more example embodiments, can be used to reposition a panel. Repositioning the panel can include rotating the panel to a vertical or substantially vertical position by turning rotator 108. Repositioning the panel can include rotating the panel to a horizontal or substantially horizontal position by turning rotator 108. Repositioning the panel can include raising and lowering the panel or rotating the panel to a position between a vertical position and a horizontal position of the panel.

A panel hoist, in accordance with one or more example embodiments, can be rolled or otherwise moved towards an opening on a van or trailer body for positioning of a panel for attaching the panel to the van or trailer body.

VI. Additional Details and Alternative Arrangements

Figure 13:
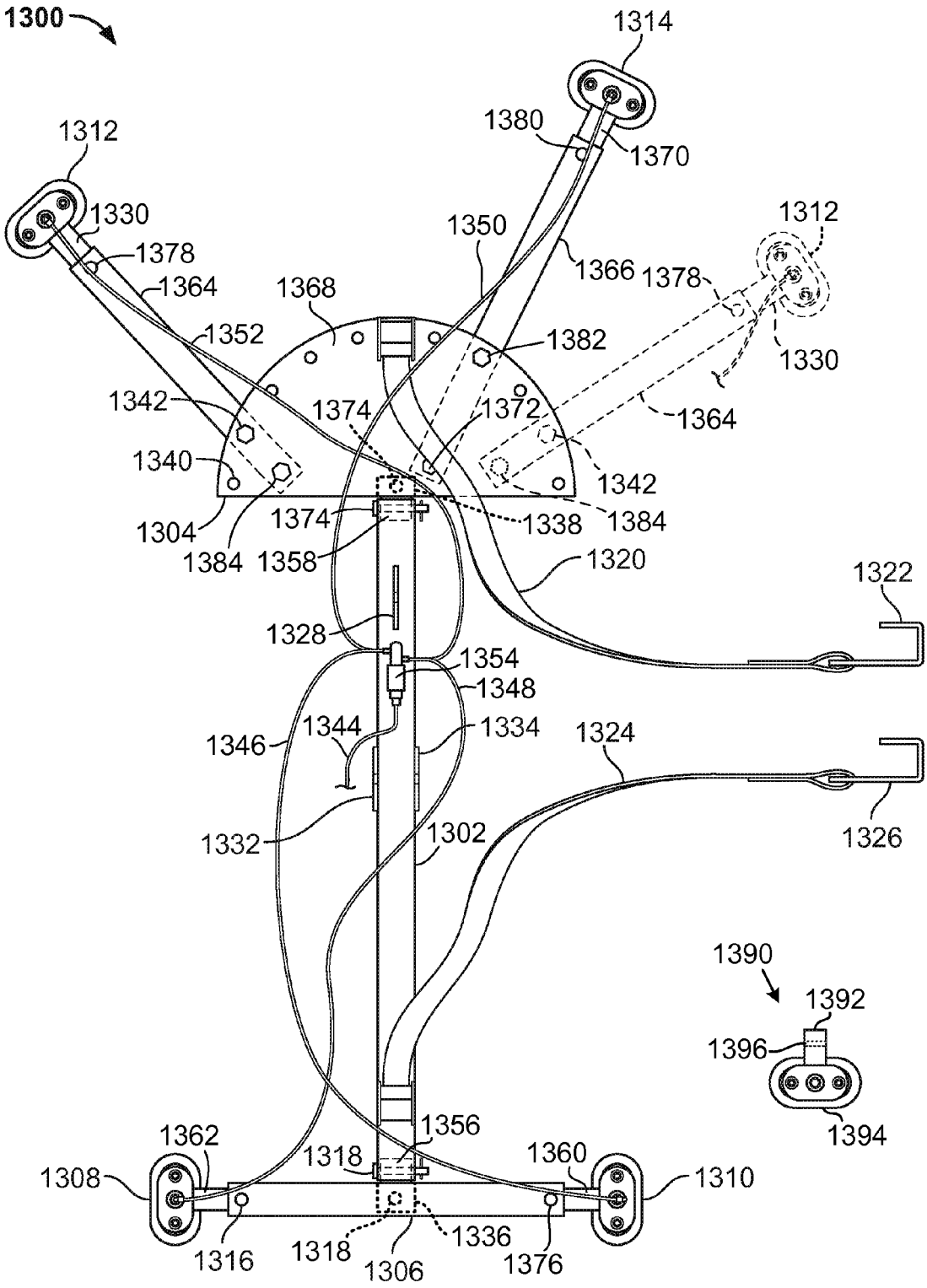
FIG. 13 shows details of an alternative panel holder in accordance with one or more example embodiments.

FIG. 13 shows details of a panel holder 1300 in accordance with one or more example embodiments. Panel holder 1300 can be used as part of a panel hoist, such as panel hoist 100. For example, panel holder 1300 can be used as part of panel hoist 100 in place of panel holder 106.

Panel holder 1300 includes a bracket body 1302, a multi-position branch bracket 1304, and a branch bracket 1306. Bracket body 1302 can include or be made of a rectangular or circular steel pipe or tube. Similarly, branch bracket 1306 can include or be made of a rectangular or circular steel pipe or tube. Other examples of material(s) used to make bracket body 1302 and branch bracket 1306 and the shapes of those material(s) are also possible.

Branch bracket 1306 and multi-position branch bracket 1304 include extensions 1356 and 1358, respectively. Extensions 1356 and 1358 can include or be made of a rectangular or circular steel pipe or tube. The dimensions of extensions 1356 and 1358 can be selected for positioning extensions 1356 and 1358 within or surrounding a portion of bracket body 1302. A fastener 1318 can be positioned within extension 1356 and bracket body 1302 to attach bracket body 1302 and branch bracket 1306 together. Similarly, a fastener 1374 can be positioned within extension 1358 and bracket body 1302 to attach bracket body 1302 and multi-position branch bracket 1304 together. Fasteners 1318 and 1374 can comprise a rounded retainer locking pin having a 0.25 inch diameter and a length of 2.5 inches and a through-hole for installing a cotter pin or other fastener retainer. Alternatively, fasteners 1318 or 1374 can comprise a hex head bolt and nut, or some other type of fastener.

In an alternative arrangement, an end portion 1336 of branch body 1302 can be positioned within branch bracket 1306, with or without use of extender 1356. FIG. 13 illustrates, using broken lines, an example position for fastener 1318 in accordance with this alternative arrangement.

In another alternative arrangement, an end portion 1338 of branch body 1302 can be positioned between branch attachment portion 1368 and a second branch attachment portion (not shown) of multi-position branch bracket 1304, with our without use of extender 1358. FIG. 13 illustrates, using broken lines, an example position for fastener 1374 in accordance with this alternative arrangement.

Branch extenders 1360 and 1362 can be positioned within or surrounding portions of branch bracket 1306. A fastener 1316 can be positioned within branch extender 1362 and branch bracket 1306 to attach those components together. Similarly, a fastener 1376 can be positioned within branch extender 1360 and branch bracket 1306 to attach those components together. Fasteners 1316 and 1376 can comprise a rounded retainer locking pin having a 0.25 inch diameter and a length of 2.5 inches and a through-hole for installing a cotter pin or other fastener retainer. Other examples of fasteners 1316 and 1376 are also possible. Fasteners 1316 and 1376 can be positioned within attachment holes of branch extenders 1360 and 1362 that align with attachment holes of branch bracket 1306.

A suction cup 1308 can be positioned at a distal end of branch extender 1362 relative to bracket body 1302, and a suction cup 1310 can be positioned at a distal end of branch extender 1360 relative to bracket body 1302. Branch extenders 1360 and 1362 or branch bracket 1306 can be configured with multiple attachment holes to allow one or more of branch extenders 1360 and 1362 to slide within or over branch bracket 1306 such that a suction cup attached to those branch extenders is moved closer to or further away from bracket body 1302.

Multi-position branch bracket 1304 includes branch attachment portion 1368, the second branch attachment portion (not shown), and multiple branch attachment portion separators. Each of those components can be made of metal, such as any of a plurality of types of steel. Each branch attachment portion separator can comprise a rectangular piece of steel plate, such as a two inch by two inch by three eighths inch steel plate welded to or near the straight edges of the two branch attachment portions. One or more of the branch attachment portion separators can be positioned between the two branch attachment portions.

Each of the branch attachment portions can be similarly shaped, such as the semi-circle shaped branch attachment portion 1368. Each of the branch attachment portions can have multiple fastener holes 1340. The branch attachment portions can be separated by the multiple branch attachment portion separators and by branches 1364 and 1366. The branch attachment portions can be aligned such that fastener holes 1340 of branch attachment portion 1368 align with similarly-positioned fastener holes in the second branch attachment portion.

Panel holder 1300 includes branches 1364 and 1366, branch extenders 1330 and 1370, and suction cups 1312 and 1314. Suction cup 1312 is attached at a distal end of branch extender 1330 relative to multi-position branch bracket 1304. Similarly, suction cup 1314 is attached at a distal end of branch extender 1370 relative to multi-position branch bracket 1304. In an alternative arrangement, suction cup 1312 can be attached directly to branch 1364 without using branch extender 1330, and suction cup 1314 can be attached directly to branch 1366 without using branch extender 1370.

Branch extenders 1330 and 1370 or branches 1364 and 1366 can be configured with multiple attachment holes to allow one or more of branch extenders 1330 or 1370 to slide within or over branch extenders 1330 and 1370 such that a suction cup attached to one of those branch extenders is moved closer to or further away from multi-position branch bracket 1304. Fasteners 1378 and 1380 can be positioned within attachment holes of branch extenders 1330 and 1370 that align with attachment holes of branches 1364 and 1366, respectively. Fasteners 1378 and 1380 can be configured like fastener 1318 or another fastener.

Branch 1364 is attached to multi-position branch bracket 1304 using fasteners 1342 and 1384, and branch 1366 is attached to multi-position branch bracket 1304 using fasteners 1372 and 1382. As an example, fasteners 1342, 1372, 1382, and 1384 can comprise hex head bolts and nuts or fastener pins, such as clevis pins. Branches 1364 and 1366 can swing up and down while rotating about fasteners 1384 and 1372, respectively, and while fasteners 1342 and 1382 are not installed.

Branch 1364 can be repositioned and attached within multi-position branch bracket 1304 by removing fastener 1342, loosening fastener 1384 if fastener 1384 comprises a bolt and nut, sliding branch 1364 from its current position to a new position, aligning branch 1364 so that a fastener hole within branch 1364 aligns with a fastener hole 1340 at the new position, installing fastener 1342 at the new position, and tightening fasteners 1342 and 1384 if fastener 1384 comprises a bolt and nut. Similarly, branch 1366 can be repositioned and attached within multi-position branch bracket 1304 by removing fastener 1382, loosening fastener 1372 if fastener 1372 comprises a bolt and nut, sliding branch 1366 from its current position to a new position, aligning branch 1366 so that a fastener hole within branch 1366 aligns with a fastener hole 1340 at the new position, installing fastener 1382 at the new position, and tightening fasteners 1372 and 1382.

Panel holder 1300 comprises secondary panel holders 1320 and 1324 and gripper clips 1322 and 1326 attached to secondary panel holders 1320 and 1324, respectively. FIG. 13 shows secondary panel holder 1320 attached to multi-position branch bracket 1304 and secondary panel holder 1324 attached to bracket body 1306. One or more of secondary panel holders 1320 and 1324 can be attached to another portion of panel holder 1300. Secondary panel holders 1320 and 1324 can each be configured like secondary panel holder 116. For example, secondary panel holders 1320 and 1324 can each include a first strap, a second strap, a first ratchet tensioner, and a second ratchet tensioner. Secondary panel holders 1320 and 1324 can be used to hold a panel in the manner in which secondary panel holders are used to hold panel 104 as shown in FIG. 1.

Panel holder 1300 comprises attachment bracket segments 1332 and 1334 for attaching panel holder 1300 to a hoist arm, such as hoist arm of panel hoist 100. Attachment bracket segments 1332 and 1334 can be configured like attachment bracket segments as shown in FIG. 12.

Panel holder 1300 comprises attachment bracket 1328 for attaching panel holder 1300 to a rotator, such as rotator 108. Attachment bracket 1328 can be configured like attachment bracket, as shown in FIG. 12.

Panel holder 1300 can comprise multiple air supply lines and an air distributor valve 1354 to which the air supply lines can be attached. The air supply lines can include an air line 1344 that supplies air to air distributor valve 1354, and air lines 1346, 1348, 1350, and 1352 that connect to suction cups 1310, 1308, 1314, and 1312, respectively.

FIG. 13 shows suction cups 1308, 1310, 1312, and 1314 as being pneumatic suction cups. In an alternative arrangement, one or more of suction cups 1308, 1310, 1312, and 1314 can comprise a manual suction cup.

In alternative arrangements usable with one or more example embodiments, a multi-position branch bracket like multi-position branch bracket 1304 can be attached at both ends of bracket body 1302. In accordance with those alternative arrangements, one of the multi-position branch brackets is used in place of branch bracket 1306. In other alternative arrangements usable with one or more example embodiments, a branch bracket like branch bracket 1306 can be attached at both ends of bracket body 1302. In accordance with those other alternative arrangements, one of the branch brackets is used in place of multi-position branch bracket 1304.

FIG. 13 shows an alternative branch 1390 that can be used with panel holder 1300 instead of multi-position branch bracket 1304 or branch bracket 1306. Branch 1390 has a branch attachment segment 1392, a suction cup 1394, and an attachment hole 1396. Branch attachment segment 1392 can attach to bracket body 1302 using fastener 1318 or 1374 in the manner in which extensions 1356 and 1358 are attached to bracket body. Suction cup 1394 can comprise a pneumatic or manual suction cup.

Figure 14:
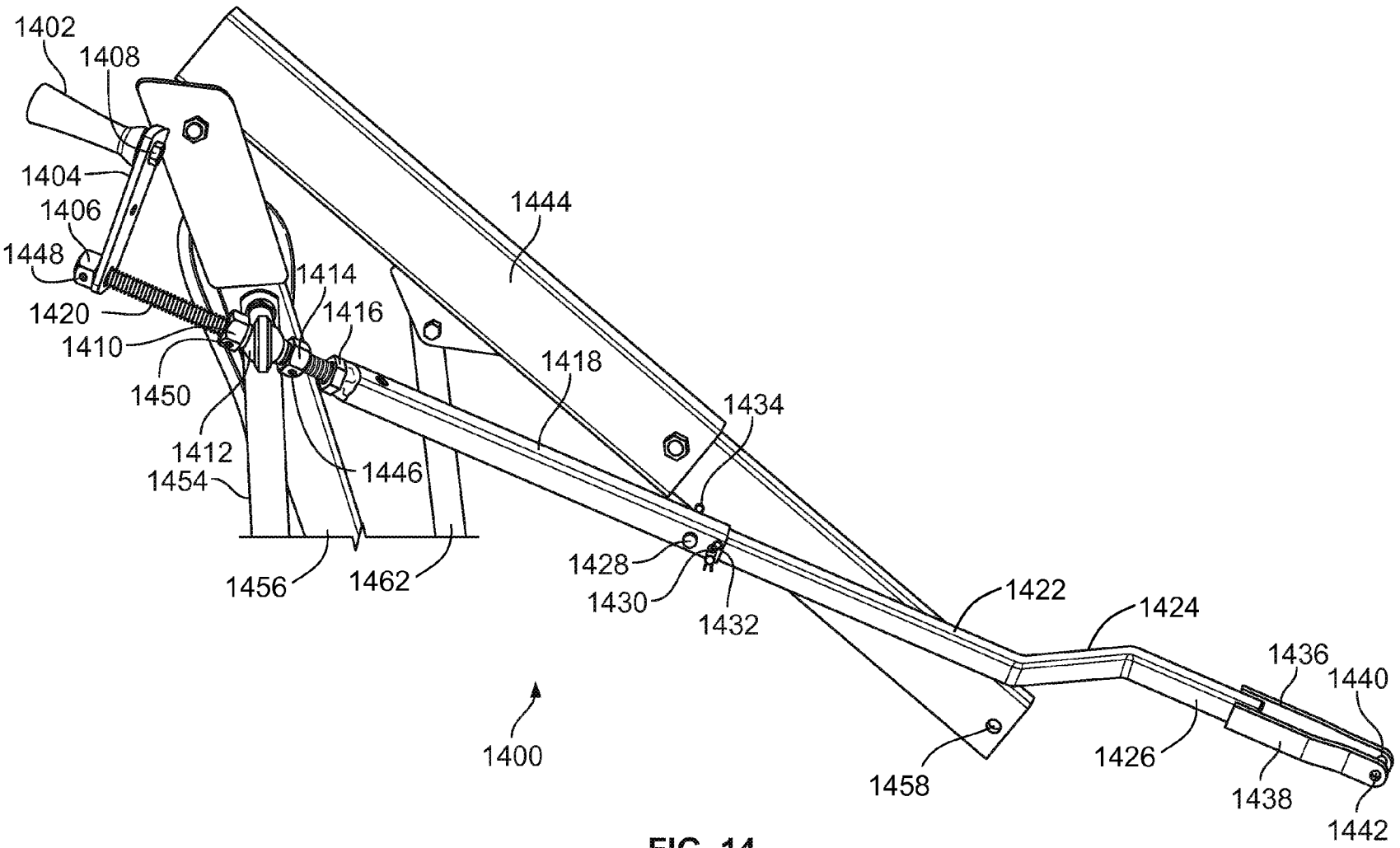
FIG. 14 shows details of a panel rotator in accordance with one or more example embodiments.

Next, FIG. 14 shows an example panel rotator 1400 (or more simply, a rotator) and various panel hoist components in accordance with one or more example embodiments. The panel hoist components include hoist arm 1444, stabilizer 1454, hoist arm support 1456, and jack ram 1462. Hoist arm 1444 includes an attachment hole 1458 for attaching hoist arm 1444 to an attachment bracket, such as attachment bracket segments and shown in FIG. 11 and attachment bracket segments 1332 and 1334 shown in FIG. 13. Hoist arm 1444 can be configured like hoist arm shown in FIG. 1. Stabilizer 1454 can be configured like stabilizer shown in FIG. 1. Hoist arm support 1456 can be arranged like hoist arm support shown in FIG. 1. Jack ram 1462 can be configured like jack ram shown in FIG. 2.

Rotator 1400 includes a handle 1402, a handle bracket 1404, a threaded shaft (or threaded rod) 1420, rotator shaft segments 1418, 1422, 1424, 1426, and panel holder attachment brackets 1436 and 1438. Handle 1402 and handle bracket 1404 can be attached together using a fastener 1408, such as a hex head bolt and a lock washer. Rotator shaft segments 1422, 1424, and 1426 can be formed from a single steel bar or tube. Rotator shaft segment 1418 can be formed from a single steel bar or tube.

Rotator shaft segment 1424 provides for rotator shaft segments 1422 and 1426 being offset from one another. The offset provided by rotator shaft segment 1424 provides for rotator shaft segment 1426 and panel holder attachment brackets 1436 and 1438 to be in line with hoist arm 1444, such that hoist arm 1444 and panel holder attachment brackets 1436 and 1438 can be attached to panel hoist 106 or 1300. Panel holder attachment brackets 1436 and 1438 include attachment holes 1440 and 1442, respectively, for receiving a fastener to attach rotator 1400 to attachment bracket. Panel holder brackets 1436 and 1438 can form a U-shaped yoke that is configured to fit over an attachment bracket (such as attachment bracket 1328) on a panel holder and that is configured to be retained to the attachment bracket by a fastener pin or other fastener positioned within attachment holes 1440 and 1442.

Rotator 1400 includes fasteners 1428 and 1430 to attach rotator shaft segments 1418 and 1422 to one another. FIG. 14 shows fasteners 1428 and 1430 as clevis or retainer pins secured to rotator shaft segments 1428 and 1430 by cotter pins 1434 and 1432 respectively. Alternatively, fasteners 1428 and 1430 can comprise hex head bolts and nuts or some other type of fastener. Fasteners 1428 and 1430 can removed to allow for disassembly of rotator 1400 so as to allow for easier shipment of a rotator 1400 or a panel hoist including rotator 1400.

Rotator 1400 includes nuts 1406, 1410, and 1414 having set screws 1448, 1450, and 1446, respectively. Those set screws provide for positioning nuts 1406, 1410, and 1414 to threaded shaft 1420 so that nuts 1406, 1410, and 1412 turn with threaded shaft 1420. Rotator 1400 also includes nut 1416 and swivel ball joint 1412. Threaded shaft 1420 slides through and spins on swivel ball joint 1412. Nuts 1410 and 1414 can be used as stops to position threaded rod 1420 within swivel ball joint 1412. Nut 1416 can be welded or otherwise attached to rotator shaft segment 1418. Threaded shaft 1420 can turn and move through nut 1416 into or out of rotator shaft segment 1418 so at to change the length of rotator 1400. The changing length of rotator 1400 causes a panel attached to a panel holder attached to rotator 1400 to rotate.

VII. Conclusion

Example embodiments have been described above. Those skilled in the art will understand that changes and modifications can be made to the described embodiments without departing from the true scope and spirit of the present invention, which is defined by the claims.

We claim:

1. A panel hoist comprising:
a base;
a hoist arm connected to the base;
a jack configured to raise and lower the hoist arm;
a panel holder;
a rotator configured to rotate the panel holder,
wherein the length of the rotator is adjustable,
wherein the rotator comprises a shaft including a first shaft segment and a second shaft segment,
wherein the first shaft segment includes a first end and a second end,
wherein the first end of the first shaft segment includes a first threaded portion,
wherein the second shaft segment includes a first end and a second end,
wherein the first end of the second shaft segment includes a second threaded portion configured to engage the first threaded portion of the first shaft segment,
wherein the second end of the second shaft segment is configured for connection to the second rotatable joint;
a first rotatable joint that connects the hoist arm to the panel holder, and
a second rotatable joint that connects the rotator to the panel holder.

2. The panel hoist of claim 1, wherein the jack comprises a hydraulic jack or an air over hydraulic jack.

3. The panel hoist of claim 1, further comprising:
a swivel ball joint,
wherein the first shaft segment is configured to slide through and spin on the swivel ball joint, and
wherein a length of the rotator decreases by rotating a portion of the first shaft segment further into the second shaft segment and increases by rotating the portion of the first shaft segment out of the second shaft segment.

4. The panel hoist of claim 1,
wherein the first threaded portion is within an interior portion of the first end of the first shaft segment, and
wherein the second threaded portion is on an exterior portion of the first end of the second shaft segment.

5. The panel hoist of claim 1,
wherein the first threaded portion is on an exterior portion of the first end of the first shaft segment, and
wherein the second threaded portion is within an interior portion of the first end of the second shaft segment.

6. The panel hoist of claim 1,
wherein the second shaft segment comprises a first segment portion including the first end, a second segment portion including the second end, and an offset portion between the first segment portion and the second segment portion,
wherein a longitudinal axis of the offset portion is not parallel to a longitudinal axis of the first segment portion, and
wherein the longitudinal axis of the offset portion is not parallel to a longitudinal axis of the second segment portion.

7. The panel hoist of claim 1, further comprising:
a plurality of suction cups connected to the panel holder; and
a plurality of air ejectors,
wherein each air ejector is configured to provide a vacuum in proximity to a respective suction cup of the plurality of suction cups.

8. The panel hoist of claim 1,
wherein the panel holder comprises a body and a plurality of arms extending from the body, and
wherein a respective suction cup and a respective air ejector are connected at a distal end, relative to the body, of each arm.

9. The panel hoist of claim 8, wherein each arm of the plurality of arms comprises a telescoping arm.

10. The panel hoist of claim 1,
wherein the panel holder comprises a body and a plurality of arms extending from the body, and
wherein a respective manual suction cup is connected at a distal end, relative to the body, of each arm.

11. The panel hoist of claim 1, further comprising:
a secondary panel holder connected to the panel holder.

12. The panel hoist of claim 11,
wherein the secondary panel holder comprises a first strap, a second strap, a first ratchet tensioner, and a second ratchet tensioner,
wherein the first ratchet tensioner and the second ratchet tensioner are attached to the panel holder,
wherein a first portion of the first strap is attachable to the first ratchet tensioner and a second portion of the first strap includes a first hook configured for contacting a panel,
wherein a first portion of the second strap is attachable to the second ratchet tensioner and a second portion of the second strap includes a second hook configured for contacting the panel,
wherein the first ratchet tensioner is operable to increase tension on the first strap, and
wherein the second ratchet tensioner is operable to increase tension on the second strap.

13. The panel hoist of claim 1, further comprising:
an air delivery system including a connector adapted for connection to an air supply line, and including at least one air delivery line adapted for supplying compressed air to an air ejector,
wherein the air ejector is adapted for providing a vacuum in proximity to a suction cup connected to the panel holder.

14. The panel hoist of claim 1, further comprising:
a hydraulic lift comprising the base and the hoist arm of the panel holder.

15. The panel hoist of claim 1,
wherein the panel holder comprises a branch body and a multi-position branch bracket removably attachable to the branch body, wherein the multi-position branch bracket includes attachment holes for attaching multiple branches to the multi-position branch bracket, and wherein each branch of the multiple branches includes a suction cup proximate to a distal end of the branch relative to the multi-position branch bracket.

16. The panel hoist of claim 15, wherein a first branch of the multiple branches is removably attached to the multi-position branch bracket at a first position by a first fastener within a first attachment hole and a second fastener within a second attachment hole, wherein the first branch can be removably attached to the multi-position branch bracket at a second position by the first fastener within the first attachment hole and the second fastener within a third attachment hole, and wherein the first branch is configured to pivot about the first fastener during movement of the first branch from the first position to the second position.

17. The panel hoist of claim 16, further comprising:

a branch bracket removably attachable at a first end of the branch body, wherein at least one suction cup is attached to the branch bracket, and wherein the multi-position branch bracket is removably attachable to a second end of the branch body opposite the first end of the branch body.

18. The panel hoist of claim 15, wherein the multi-position branch bracket comprises a first branch attachment portion, a second branch attachment portion, and one or more branch attachment portion separators positioned between the first branch attachment portion and the second branch attachment portion, and wherein portions of each branch of the multiple branches can be positioned between the first branch attachment portion and the second branch attachment portion.

19. The panel hoist of claim 18, wherein first branch attachment portion comprises a first semi-circled shaped steel plate and the second branch attachment portion comprise a second semi-circled shaped steel plate.

20. A kit comprising:

a panel holder;

a rotator configured to rotate the panel holder, wherein the length of the rotator is adjustable;

a first rotatable joint adapted to be connected to the panel holder and to a hoist arm of a hydraulic lift, a second rotatable joint adapted to connect the rotator to the panel holder; and a plurality of suction cups adapted for connection to the panel holder;

a secondary panel holder connected to the panel holder, wherein the secondary panel holder comprises a first strap, a second strap, a first ratchet tensioner, and a second ratchet tensioner, wherein the first ratchet tensioner and the second ratchet tensioner are attached to the panel holder, wherein a first portion of the first strap is attachable to the first ratchet tensioner and a second portion of the first strap includes a first hook configured for contacting a panel, wherein a first portion of the second strap is attachable to the second ratchet tensioner and a second portion of the second strap includes a second hook configured for contacting the panel, wherein the first ratchet tensioner is operable to increase tension on the first strap, and wherein the second ratchet tensioner is operable to increase tension on the second strap.

21. A kit comprising:

a panel holder;

a rotator configured to rotate the panel holder, wherein the length of the rotator is adjustable, wherein the rotator comprises a shaft including a first shaft segment and a second shaft segment, wherein the first shaft segment includes a first end and a second end, wherein the first end of the first shaft segment includes a first threaded portion, wherein the second shaft segment includes a first end and a second end, wherein the first end of the second shaft segment includes a second threaded portion configured to engage the first threaded portion of the first shaft segment, wherein the second end of the second shaft segment is configured for connection to the second rotatable joint;

a first rotatable joint adapted to be connected to the panel holder and to a hoist arm of a hydraulic lift, a second rotatable joint adapted to connect the rotator to the panel holder; and a plurality of suction cups adapted for connection to the panel holder.

22. The kit of claim 21, further comprising:

an air-over-hydraulic jack.

* * * * *